US010582787B2

(12) United States Patent
Panek et al.

(10) Patent No.: US 10,582,787 B2
(45) Date of Patent: Mar. 10, 2020

(54) PAPER-BASED CONTAINER LIDS AND METHODS FOR MAKING THE SAME

(71) Applicant: PTM PACKAGING TOOLS MACHINERY PTE. LTD., Singapore (SG)

(72) Inventors: Joel C. Panek, Moseley, VA (US); Wade Harris, Lumberton, TX (US); Bhagwandat Mohan, Henrico, VA (US); Rune K. Haraldsson, Ashland, VA (US); Matthew E. Zacherle, Chesterfield, VA (US); Jeremy D. Mowery, Memphis, TN (US)

(73) Assignee: PTM PACKAGING TOOLS MACHINERY PTE. LTD., Singapore (SG)

( * ) Notice: Subject to any disclaimer, the term of this patent is extended or adjusted under 35 U.S.C. 154(b) by 0 days.

(21) Appl. No.: 13/973,663

(22) Filed: Aug. 22, 2013

(65) Prior Publication Data

US 2014/0054306 A1 Feb. 27, 2014

Related U.S. Application Data

(60) Provisional application No. 61/692,065, filed on Aug. 22, 2012.

(51) Int. Cl.
*B65D 43/02* (2006.01)
*A47G 19/22* (2006.01)

(52) U.S. Cl.
CPC ..... *A47G 19/2272* (2013.01); *B65D 43/0212* (2013.01); *B65D 43/0214* (2013.01); *B65D 2543/00027* (2013.01); *B65D 2543/00046* (2013.01); *B65D 2543/00092* (2013.01); *B65D 2543/00268* (2013.01)

(58) Field of Classification Search
CPC ..... A47G 19/2272; B65D 2543/0024; B65D 2543/00268; B65D 2543/00046; B65D 47/043
USPC ..... 220/713, 716, 719, 731, 711, 703–704, 220/718, 717; 229/906.1, 404; 215/310
See application file for complete search history.

(56) References Cited

U.S. PATENT DOCUMENTS

| | | | |
|---|---|---|---|
| 2,069,213 | A | 2/1937 | Carew |
| 3,938,695 | A | 2/1976 | Ruff |
| 4,305,524 | A | 12/1981 | McLaren et al. |
| 4,351,472 | A | 9/1982 | Eddy |

(Continued)

FOREIGN PATENT DOCUMENTS

| | | | |
|---|---|---|---|
| DE | 202011004178 | U1 | 5/2011 |
| EP | 0907576 | A1 | 4/1999 |

(Continued)

OTHER PUBLICATIONS

International Search Report dated Nov. 8, 2013 from corresponding PCT Application No. PCT/US2013/056239.

(Continued)

*Primary Examiner* — Robert Poon
(74) *Attorney, Agent, or Firm* — Flynn Thiel, P.C.

(57) ABSTRACT

A paper-based container lid comprises a top wall, a side wall connecting to the top wall, and a sealing channel formed on the side wall for sealingly engaging a rim of the container and securing the lid to the container, wherein the top wall and the side wall are preferably formed from separate blanks.

6 Claims, 16 Drawing Sheets

(56) References Cited

U.S. PATENT DOCUMENTS

| | | | | |
|---|---|---|---|---|
| 5,398,843 | A * | 3/1995 | Warden | B65D 43/0212 220/254.1 |
| 5,637,332 | A | 6/1997 | Ridout | |
| 5,960,986 | A | 10/1999 | Nielsen et al. | |
| 6,047,878 | A | 4/2000 | Lowry | |
| 6,056,145 | A | 5/2000 | Rush et al. | |
| 6,230,924 | B1 * | 5/2001 | Weiss et al. | 220/713 |
| 6,364,201 | B1 | 4/2002 | Varano | |
| 6,454,118 | B1 | 9/2002 | D'Amato | |
| D537,717 | S | 3/2007 | Notarianni | |
| 8,205,768 | B2 * | 6/2012 | Shiffer | B65D 43/0212 220/713 |
| 2005/0224505 | A1 | 10/2005 | Brown et al. | |
| 2006/0009338 | A1 * | 1/2006 | Kirkpatrick et al. | 493/104 |
| 2006/0261070 | A1 | 11/2006 | Robertson et al. | |
| 2008/0006643 | A1 | 1/2008 | Ma | |
| 2008/0099481 | A1 * | 5/2008 | D'Amato | B65D 43/0262 220/276 |
| 2009/0057311 | A1 | 3/2009 | Lie et al. | |
| 2009/0236409 | A1 * | 9/2009 | Flores | 229/404 |
| 2009/0283526 | A1 | 11/2009 | Pierce et al. | |
| 2010/0147447 | A1 | 6/2010 | Mazzarolo | |
| 2010/0163568 | A1 | 7/2010 | Mucci et al. | |
| 2010/0176130 | A1 | 7/2010 | Kim | |
| 2010/0243722 | A1 | 9/2010 | Hyder et al. | |
| 2010/0252555 | A1 | 10/2010 | Syed | |
| 2010/0288827 | A1 * | 11/2010 | Booth | 229/404 |
| 2010/0301109 | A1 | 12/2010 | Lewis et al. | |
| 2010/0323865 | A1 * | 12/2010 | Zeiler | 493/84 |
| 2011/0011549 | A1 | 1/2011 | Pierce et al. | |
| 2012/0241453 | A1 * | 9/2012 | Palmer | B65D 47/043 220/254.3 |
| 2013/0334228 | A1 | 12/2013 | Schmidtner et al. | |

FOREIGN PATENT DOCUMENTS

| | | | |
|---|---|---|---|
| EP | 0911272 | A1 | 4/1999 |
| EP | 1727742 | A1 | 12/2006 |
| EP | 1855956 | A1 | 11/2007 |
| EP | 1874645 | A1 | 1/2008 |
| EP | 1931571 | A1 | 6/2008 |
| EP | 2105388 | A1 | 9/2009 |
| EP | 2159161 | A1 | 3/2010 |
| EP | 2271562 | A1 | 1/2011 |
| JP | S60-106958 | U | 7/1985 |
| JP | 2000079935 | A | 3/2000 |
| JP | 2000103446 | A | 4/2000 |
| JP | 2000219264 | A | 8/2000 |
| JP | 2000238738 | A | 9/2000 |
| JP | 2000238810 | A | 9/2000 |
| JP | 2000355366 | A | 12/2000 |
| JP | 2001122319 | A | 5/2001 |
| JP | 2001139016 | A | 5/2001 |
| JP | 2001206339 | A | 7/2001 |
| JP | 2001233320 | A | 8/2001 |
| JP | 2001287765 | A | 10/2001 |
| JP | 2002002764 | A | 1/2002 |
| JP | 3259629 | B2 | 2/2002 |
| JP | 2002087451 | A | 3/2002 |
| JP | 2002104512 | A | 4/2002 |
| JP | 3289466 | B2 | 6/2002 |
| JP | 2002274554 | A | 9/2002 |
| JP | 2002293368 | A | 10/2002 |
| JP | 2002347742 | A | 12/2002 |
| JP | 2003072733 | A | 3/2003 |
| JP | 2003128104 | A | 5/2003 |
| JP | 2003182721 | A | 7/2003 |
| JP | 2003182759 | A | 7/2003 |
| JP | 3432316 | B2 | 8/2003 |
| JP | 2003231517 | A | 8/2003 |
| JP | 2003237760 | A | 8/2003 |
| JP | 2003341648 | A | 12/2003 |
| JP | 2004008610 | A | 1/2004 |
| JP | 2004010146 | A | 1/2004 |
| JP | 2004018024 | A | 1/2004 |
| JP | 3496776 | B2 | 2/2004 |
| JP | 2004-123105 | A | 4/2004 |
| JP | 2004106858 | A | 4/2004 |
| JP | 2004106918 | A | 4/2004 |
| JP | 2004115117 | A | 4/2004 |
| JP | 2004189253 | A | 7/2004 |
| JP | 2004196308 | A | 7/2004 |
| JP | 2004231211 | A | 8/2004 |
| JP | 2004231212 | A | 8/2004 |
| JP | 2004238048 | A | 8/2004 |
| JP | 2004314987 | A | 11/2004 |
| JP | 2004-359314 | A | 12/2004 |
| JP | 2005096819 | A | 4/2005 |
| JP | 2005126140 | A | 5/2005 |
| JP | 3654966 | B2 | 6/2005 |
| JP | 2005206214 | A | 8/2005 |
| JP | 2005230298 | A | 9/2005 |
| JP | 2005263228 | A | 9/2005 |
| JP | 2005271999 | A | 10/2005 |
| JP | 2005343557 | A | 12/2005 |
| JP | 2006-069642 | A | 3/2006 |
| JP | 3797441 | B2 | 7/2006 |
| JP | 2006222274 | A | 8/2006 |
| JP | 2006248530 | A | 9/2006 |
| JP | 3830693 | B2 | 10/2006 |
| JP | 3846093 | B2 | 11/2006 |
| JP | 2007030933 | A | 2/2007 |
| JP | 2007039093 | A | 2/2007 |
| JP | 3924986 | B2 | 6/2007 |
| JP | 2007137447 | A | 6/2007 |
| JP | 3964967 | B2 | 8/2007 |
| JP | 2007204148 | A | 8/2007 |
| JP | 2007238140 | A | 9/2007 |
| JP | 3984472 | B2 | 10/2007 |
| JP | 2007-290717 | A | 11/2007 |
| JP | 2007-537940 | A | 12/2007 |
| JP | 2008-062952 | A | 3/2008 |
| JP | 2008074410 | A | 4/2008 |
| JP | 3142176 | U | 6/2008 |
| JP | 4106316 | B2 | 6/2008 |
| JP | 2008155971 | A | 7/2008 |
| JP | 2008155972 | A | 7/2008 |
| JP | 2008189337 | A | 8/2008 |
| JP | 2008189345 | A | 8/2008 |
| JP | 2008222245 | A | 9/2008 |
| JP | 2008222273 | A | 9/2008 |
| JP | 2008222274 | A | 9/2008 |
| JP | 2008280072 | A | 11/2008 |
| JP | 2009001333 | A | 1/2009 |
| JP | 2009220852 | A | 10/2009 |
| JP | 2009292528 | A | 12/2009 |
| JP | 2009298427 | A | 12/2009 |
| JP | 2010006390 | A | 1/2010 |
| JP | 2010023840 | A | 2/2010 |
| JP | 2010132344 | A | 6/2010 |
| JP | 2010137902 | A | 6/2010 |
| JP | 4508402 | B2 | 7/2010 |
| JP | 4539010 | B2 | 9/2010 |
| JP | 2010189009 | A | 9/2010 |
| JP | 2010-247937 | A | 11/2010 |
| JP | 3165311 | U | 1/2011 |
| JP | 2011051655 | A | 3/2011 |
| WO | WO-1997039958 | A1 | 10/1997 |
| WO | WO-2001074683 | A1 | 10/2001 |
| WO | WO-2005032962 | A1 | 4/2005 |
| WO | WO-2005039990 | A2 | 5/2005 |
| WO | WO-2005090194 | A1 | 9/2005 |
| WO | WO-2006086267 | A2 | 8/2006 |
| WO | WO-2006089432 | A1 | 8/2006 |
| WO | WO-2006116707 | A1 | 11/2006 |
| WO | WO-2007052014 | A1 | 5/2007 |
| WO | WO-2007078265 | A2 | 7/2007 |
| WO | WO-2007110897 | A1 | 10/2007 |
| WO | WO-2007113215 | A1 | 10/2007 |
| WO | WO-2009014771 | A1 | 1/2009 |
| WO | WO-2009130313 | A1 | 10/2009 |
| WO | WO-2009154843 | A1 | 12/2009 |
| WO | WO-2010028677 | A1 | 3/2010 |

(56) References Cited

FOREIGN PATENT DOCUMENTS

| | | | |
|---|---|---|---|
| WO | WO-2010043960 | A2 | 4/2010 |
| WO | WO-2010082711 | A1 | 7/2010 |
| WO | WO-2012082067 | A1 | 6/2012 |

OTHER PUBLICATIONS

Notice of Reasons for Rejection, with English translation, issued in Japanese Patent Application No. 2015/528660, dated Aug. 2, 2017 (14 pages).

* cited by examiner

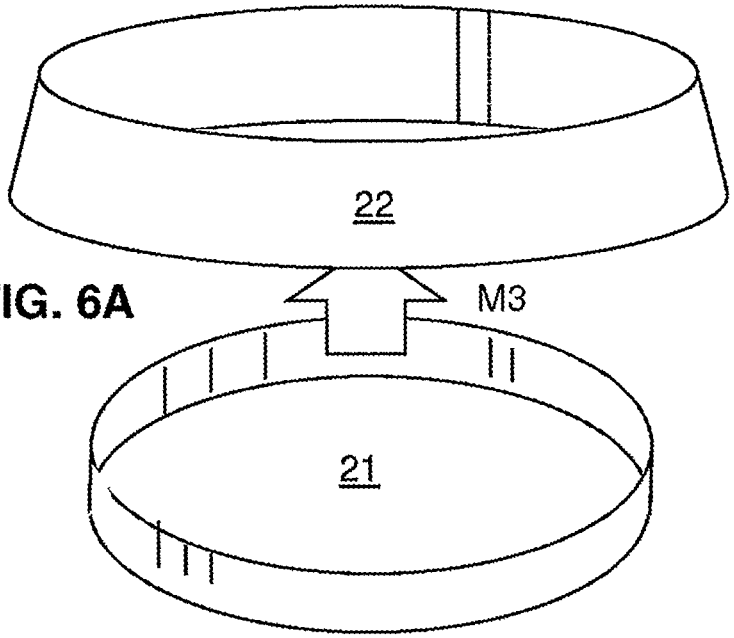
FIG. 6A
FIG. 6B
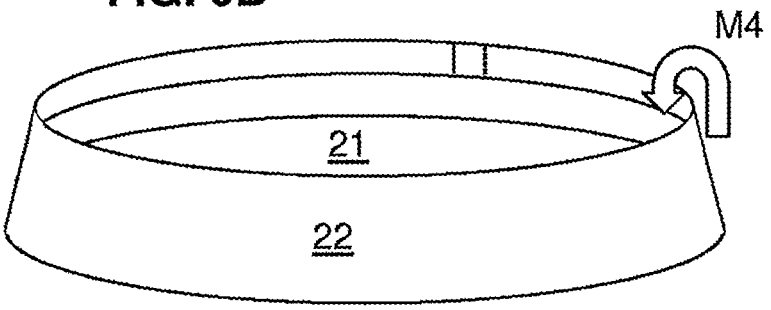
FIG. 6C
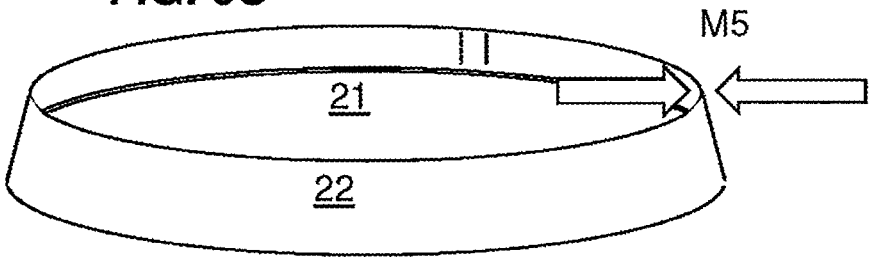

PAPER-BASED CONTAINER LIDS AND METHODS FOR MAKING THE SAME

CROSS REFERENCE TO RELATED APPLICATIONS

This application claims priority to U.S. Provisional Patent Application Ser. No. 61/692,065, filed Aug. 22, 2012, entitled Paper-Based Container Lids and Methods for Making, the disclosure of which is herein incorporated by reference in its entirety.

BACKGROUND OF THE INVENTION

1. Field of the Invention

The subject disclosure relates to paper-based container lids and methods of making the same, and more particularly to lids for containers, such as beverage cups, which can be economically formed, are capable of being used with hot liquids, and include a sealing channel that creates an enhanced sealing interface with a corresponding rim formed on the container.

2. Background of the Related Art

Hot beverages, such as coffee, tea or the like, are frequently sold as a takeout item and supplied in disposable cups with thin plastic lids fasten over the rim of drinking cups. Such lids prevent spillage and evaporation of the beverage within the cup, and help insulating the contents of the cup from the ambient temperature by closing the cup opening. Drinking cup lids, such as those used by restaurants, convenience stores, and coffee houses, are commonly made of plastics. They are inexpensive and therefore suitable for disposable use. A well-known method of manufacturing plastic cup lids is by vacuum forming, which is a plastic thermoforming process that involves forming thermoplastic sheets into three-dimensional shapes through the application of heat and pressure. During the vacuum forming process, the plastic material is heated until it becomes pliable, then placed over a mold and drawn in by a vacuum until it takes on the desired shape. The vacuum thermoforming allows cup lids to be manufactured very inexpensively.

U.S. Pat. No. 4,589,569 discloses a disposable lid of one piece plastic construction that can be manufactured relatively inexpensively. The lid is manufactured by a thermoforming operation, preferably vacuum forming. The lid includes an annular mounting portion for engaging the lip of the cup; an annular side wall extending upwardly from the mounting portion; and a top wall having a drinking opening and a recess formed adjacent the drinking opening to accommodate the upper lip of the user.

Some plastics are not biodegradable, and increasing environmental concerns drive the needs for inexpensive and biodegradable lids as alternatives for disposable plastic lids.

Efforts to produce paper-based lids for containers/cups have had limited commercial success due to the complicated manufacturing process and the poor sealing between the cup body and the lid sealing ring that results in leakage of fluid contents from the cup. The poor lid sealing and leakage is worse when the cup is for hot beverages. Lids made from a single paperboard blank do not effectively seal around the rim of the containers. During the manufacturing process, substantial crimps are formed in the sealing ring portion of the lid, resulting in gaps when the ring attaches to the rim of the container and consequently a source of fluid leaks.

U.S. Publication No. 2010/0243722 addresses the leaking problem by using paperboard lids manufactured without the substantial crimps formed in the sealing rings. The lid includes a single contiguous molded paperboard body configured to conformingly couple to the container rim. The lid is formed by placing an unformed paperboard blank inside a press machine that uses compression forces to shape the paperboard blank into the lid. The draw and pressure rings hold the blank in place, while the male and female mold components of the machine compress the blank into a lid shape. By holding the paperboard blank with draw and pressure rings while the blank is pressed into the lid shape, the formation of substantial crimps typically occurring during the press step can be prevented.

There have been reports of paper-based cups with integrated lids. For example, U.S. Pat. No. 6,592,504 discloses a disposable paperboard cup that includes a bottom insert, and a substantially truncated conical body with an integral lid and a cup opening. The integral lid is movable between a raised position and a closed position. The lid has a free edge with an opening that provides an access to the fluid contents inside the cup when the lid is in the closed position. The lid is formed from a semi-circular die-cut piece adjoined to the body portion of the cup. The cup with integrated lid requires complex folding mechanisms, rendering it expensive and difficult to manufacture. Furthermore, the cup with integrated lid possesses a wide top, which is subjected to spillage and is difficult to achieve an adequate sealing between the lid and the container body, resulting in leaking of the packaged contents.

Moreover, Inmaco BV located in the Netherlands offers for sale a paper-based cup lid. A cross-section of the cup-lid interface in the Inmaco product is illustrated in FIG. 13E. As shown therein, the Inmaco lid 80 includes a cylindrical sidewall 82 and a top wall 81. The sidewall 82 is spiral wound and is made out of 3 layers of paperboard and adhesive and includes a circumferentially formed bead 85 which extends radially inward from the sidewall 82. When the lid 80 is placed on top of the rim "R" of the cup, the sidewall 82 deflects so that the rim "R" of the cup can pass by the circumferential bead 85. Once past the bead 85, the sidewall 82 relaxes and traps the rim "R" of the cup between the bead 85, a flat section 87 of the sidewall 82 and the top wall 81.

As noted above, the bead 85 formed in the sidewall 82 around the circumference of the Inmaco lid 80 secures the lid to an appropriately sized container. The fit is fairly tight radially, i.e. there is a close match between the outer diameter of the container rim "R" and the inner diameter of the lid 80. However, there is not a tight fit axially; the lid 80 can move up and down and thus it does not provide good leak resistance for liquids. In fact, in the lids tested by the inventors, the lid could move up and down by as much as 1.5 mm. Moreover, since the sidewall 82 of the lid in the sealing zone is flat (section 87) and rim "R" is curved there is no mating contact between the sidewall 82 and rim surfaces, and thus the seal is poor.

A further disadvantage of the Inmaco lid 80 is that the sidewall has a spiral seam. It is difficult to minimize the visual impact this seam by compressing it further, because this won't necessarily make the gap between the ends of the sidewall blank smaller. Moreover, using a spiral wound sidewall makes it extremely difficult to register or position the seam at a specific location around the periphery of the lids. For these reasons and to the best knowledge of the inventors, the Inmaco lid has not been offered commercially with a hole for drinking nor has it been used with liquids.

An additional disadvantage of the Inmaco lid 80 is its stacking height. Because the sidewall of the Inmaco lid 80 is substantially straight, with no taper, and the bead 85 is formed radially inward, the stacking height of the Inmaco lid 80 is limited by the location of the bead 85 and the height of the skirt below the bead.

It is known that a bead or fill line in a beverage container such as a paper cup can be formed by utilizing a spinning forming disc, wherein the disc is spun into a position near the top of the sidewall of the paper container thereby creating a bead, groove or fill line in the sidewall of the container. This apparatus requires a cam follower in a machined cam track, a cam drive shaft in a relatively complicated header assembly, and an auxiliary loader for the spinning disc. Thus, a substantial number of precision moving parts are required. Such units are therefore relatively expensive to construct and to maintain.

To address these drawbacks, U.S. Pat. No. 4,247,277 disclosed a non-spinning apparatus for forming a fill line or groove in paper cups or containers by axially compressing an annulus of a resilient material into the inside of paper cups, thereby causing a controlled deformation of the cup material outwardly about its periphery. Rather than a rotating movement of the spinning disc, the apparatus relies on the up- and down-movement of the compressed resilient material for a formation of the fill line or groove. The outward deformation occurs internally of a cup die where a portion of the sidewall of a paper cup or container confined within the die is forced by the compressed annulus to form the fill line or groove. While this apparatus is less complicated than the spinning forming discs previously used for the same purpose, it is still a complicated apparatus which requires moving parts that tend to wear, require maintenance and replacement.

U.S. Pat. No. 5,637,332 discloses a simplified apparatus for forming a fill line in a paper container such as a paper cup that includes no moving parts. A fill line is formed by forcing a punch of a mating ring into a finished cup positioned in a die which includes an annular recess spaced below the rim of the finished cup, and the annular recess terminates in a bottom edge to serve as an anvil surface for forming the fill line.

U.S. Pat. No. 6,663,926 discloses an apparatus for forming a rib on the side wall of the cup via an operation of the rib processing tool performed outside the cup body, thereby improving the process efficiency by eliminating a need of moving a rib processing tool in and out against the cup body. Furthermore, the apparatus allows the rib to be formed gradually in the circumferential direction of the cup body, in accordance with the relative rotation between the cup body and the rib processing tool. Therefore, it is possible to reduce force added to the cup body during the rib formation in comparison with the case in which the entire rib is formed at once.

U.S. Pat. No. 7,753,832 discloses an apparatus for molding an article produced from paperboard or cardboard, wherein a momentary irradiation of the microwave frequency is exerted on the molded board to improve its moldability. To form a cup with an annular crease on the side wall, the cup is placed on a base and supported at its side wall by a carrier ring having an annular groove that is corresponding to the crease to be made in the cup. The apparatus includes a base to support the cup bottom; a carrier ring with an annular groove to support the cup side wall; a moving tool; a crease forming tool connected to the moving tool, wherein the crease forming tool is corresponding to the groove of the carrier ring and the crease to be created on the cup side wall. The moving tool is lowered inside the cup so that its lower end is level with the groove of the carrier ring, and the irradiators on the moving tool exert microwave frequency on the side of the cup at the point where the crease is to be formed to permanently mold the creased side wall.

Despite extensive research for paper-based container lids, particularly for the drinking cup lids, several drawbacks remain. Examples of such drawbacks described in part above include: complexity of production; lack of recyclability either due to the use of recyclable/compostable materials or the difficulties in operating reclamation systems when the cup and the lid are made of different materials; insufficient consumer acceptance due to inadequacies in material "mouth feel" or design, decreased aesthetic appeals when the packaged fluids stain the lid manufactured from molded pulp; and poor lid performance due to inadequate sealing of the lid to the cup, especially after several usage cycles.

Accordingly, there is still a need for paper-based container lids that can be produced economically and with less complicated processes than known paper-based lids, and which provide acceptable lid performance (if not enhanced) compared to known paper-based lids. Moreover, there is a need for paper-based container lids which can be used with hot liquids and are constructed to provide an enhanced sealing interface with the containers so as to minimize, if not eliminate, the leakage of contents packaged in the containers.

SUMMARY OF THE INVENTION

The present disclosure is directed to a lid for a container that includes, inter alia, a paperboard side wall formed from a first blank, wherein the side wall extends about a longitudinal axis and includes longitudinally opposed first and second ends; and a paperboard top wall formed from a second blank, wherein the first blank is different from the second blank. The top wall of the lid is connected to the side wall proximate the first end and the top wall includes an opening therein.

Preferably, the lid further includes a sealing channel formed in the side wall between the first end and the second end. In certain embodiments, the sealing channel projects radially outward.

It is envisioned that the side wall of the lid can include a substantially vertical seam between the first end and the second end of the side wall. The seam can be compressed. Preferably, the opening is positioned opposite of the seam.

In embodiments of the present lid disclosure, the side wall includes an inner surface which has a polymer coating; the top wall includes a lower surface and an upper surface, wherein the lower surface and the upper surface of the top wall each include a polymer coating. In such constructions, the upper surface of the top wall is connected to the inner surface of the side wall by a polymer-to-polymer bond and the lower surface of the top wall is connected to the inner surface of the side wall by a polymer-to-polymer bond.

It is envisioned that the lid of the present disclosure can include a joint section defined by where the first end of the side wall is connected to the top wall. In such constructions, the joint section includes a top end that forms a lid rim and the lid rim includes a substantially rounded section. In certain constructions, the substantially rounded section of the lid rim is oriented toward the longitudinal axis.

In certain embodiments of the present lid disclosure, the joint section further includes a middle section below the top end, wherein the rim has a width associated therewith, wherein the middle section has a width associated therewith, and wherein the width of the rim is greater than the width of the middle section.

It is further envisioned that the joint section of the lid can include a bottom end below the middle section, and wherein the bottom end flares toward the longitudinal axis.

In certain constructions of the present invention, the opening is formed in the lid below the rim. Moreover, the top wall can include a debossed section, and wherein the opening is located within the debossed section. The top wall can further include an embossed section located adjacent to the debossed section.

The present disclosure is further directed to a lid for a container that includes a paperboard side wall formed from a first blank and a paperboard top wall formed from a second blank. The side wall extends about a longitudinal axis and includes longitudinally opposed first and second ends, wherein a sealing channel is formed in the side wall between the first end and the second end. A substantially vertical seam is formed between the first end and the second end of the side wall and the side wall includes an inner surface, wherein the inner surface includes a polymer coating. In the present lid construction, the first blank is different from the second blank. Moreover, the top wall includes an opening and a lower surface and an upper surface. The lower surface and the upper surface each include a polymer coating, and the top wall is connected to the side wall proximate the first end to define a joint section. Still further, the upper surface of the top wall is connected to the inner surface of the side wall by a polymer-to-polymer bond and the lower surface of the top wall is connected to the inner surface of the side wall by a polymer-to-polymer bond.

Preferably, the sealing channel projects radially outward.

In certain embodiments, the seam is compressed.

It is envisioned that the joint section can include a top end forming a lid rim having a substantially rounded section. Moreover, the top wall can include a debossed section and the opening is located within the debossed section.

The present disclosure is also directed to a lid for a container that includes a side wall and a top wall. The side wall extends about a longitudinal axis and has longitudinally opposed first and second ends, wherein an outwardly projecting sealing channel is formed in the side wall between the first end and the second end. The top wall is connected to the side wall between the outwardly projecting sealing channel and the first end of the side wall.

In certain embodiments, the side wall is paperboard and the top wall can also be paperboard.

It is envisioned that the outwardly projecting sealing channel can have an upper portion associated therewith, and wherein the top wall is connected to the side wall adjacent to the upper portion of the outwardly projecting sealing channel.

Preferably, the top wall is connected to the side wall adjacent to the first end.

Moreover, the top wall can include an opening formed therein.

In certain constructions, the first end of the side wall defines a joint section where the top wall is connected to the side wall, wherein the joint section includes a bottom end and a top end, and wherein the top end forms a lid rim. Preferably, in embodiments wherein the top wall includes an opening formed, the opening is positioned below the lid rim.

In certain embodiments wherein the top wall includes an opening formed therein the opening is positioned approximately coplanar with the bottom end of the joint section.

Preferably, the first end of the side wall includes a flange section and a flap section which is folded over the flange section to create a lid rim. The lid rim can include an in-curled portion.

The top wall can further include an upwardly projection peripheral flange which is sandwiched between the flange section and the flap section of the first end of the side wall.

Preferably, at least a portion of the side wall is arranged at an acute angle with respect to the top wall.

In certain embodiments, the outwardly projecting sealing channel is continuous. Ideally, the shape of the outwardly projecting sealing channel is selected to provide for mating contact with a container rim.

The present disclosure is further directed to a lid for a container that includes, among other elements, a side wall and a top wall connected to the side wall. The side wall extends about a longitudinal axis and includes longitudinally opposed first and second ends. A sealing channel is positioned between the first end and the second end and a seam runs substantially vertically between the first end and the second end.

Preferably, the side wall is paperboard. Moreover, the top wall can be paperboard.

It is envisioned that the seam can be compressed. Preferably, the seam is compressed to reduce the seam thickness to less than twice a material thickness for the side wall. Moreover, the top wall can include an opening preferably positioned diametrically opposite of the seam.

In certain embodiments, the sealing channel extends radially outward from the longitudinal axis.

Preferably, the top wall includes an opening formed in an embossed drinking area which is positioned below an upper rim formed by the side wall of the lid.

The present disclosure is further directed to a lid and container combination that includes, inter alia, a container and a paperboard lid. The container has a side wall that extends about a longitudinal axis and includes longitudinally opposed top and bottom ends, the top end of the container including a rim. A bottom wall is connected to the bottom end of the side wall.

The paperboard lid includes a side wall that extends about the longitudinal axis and has longitudinally opposed first and second ends, wherein an outwardly projecting sealing channel is formed in the side wall between the first end and the second end. A top wall is connected to the side wall between the outwardly projecting sealing channel and the first end of the side wall, wherein the top wall of the lid contacts the rim of the container when the rim is engaged within the outwardly projecting sealing channel.

Preferably, a first opening is formed in the top wall of the lid that provides access to contents of the container. It is envisioned that a second opening can be provided for venting.

In certain embodiments, the rim is circular. Moreover, the outwardly projecting sealing channel can be a radially projecting sealing channel. It is envisioned that the shape of the outwardly projecting sealing channel approximates the shape of the container rim.

In certain constructions of the lid and container combination, the container is made from paperboard.

In is envisioned that in certain constructions, the outwardly projecting sealing channel has an upper portion associated therewith, and wherein the top wall is connected to the side wall adjacent to the upper portion of the outwardly projecting sealing channel. Still further, the top wall can be connected to the side wall adjacent to the first end.

The present disclosure if further directed to a lid for a container that includes, among other elements, a paperboard side wall and a paperboard top wall. The paperboard side wall extends about a longitudinal axis and has longitudinally opposed first and second ends, wherein the side wall includes a sealing channel positioned between the first end and the second end, and wherein the side wall includes inner and outer surfaces each including a polymer coating.

The paperboard top wall includes a lower surface and an upper surface, wherein the lower and upper surfaces each include a polymer coating; and wherein the first end of the side wall includes a joint section where the side wall is connected to the top wall such that the inner surface of the of the top wall is joined to the inner surface of the side wall by a polymer-to-polymer bond. Moreover, the outer surface of the top wall is joined to the inner surface of the side wall by a polymer-to-polymer bond.

In certain constructions, the sealing channel is a radially projecting sealing channel. Moreover, the sealing channel can be continuous. Still further, the sealing channel can have an upper portion associated therewith, and wherein the top wall is connected to the side wall adjacent to the upper portion of the sealing channel.

It is also envisioned that the top wall can be connected to the side wall adjacent to the first end.

Preferably, the top wall includes an opening formed therein.

In certain constructions, the joint section includes a bottom end and a top end, and wherein the top end forms a lid rim. In embodiments wherein the top wall includes an opening formed therein, the opening can be positioned below the lid rim. Alternatively, the opening can be positioned approximately coplanar with the bottom end of the joint section.

The present disclosure is also directed to a lid for a container that includes, inter alia, a side wall and a top wall. The side wall extends about a longitudinal axis and has a first end and a second end, the second end being longitudinally opposed from the first end. The side wall includes a sealing channel formed between the first end and the second end.

A joint connects the side wall to the top wall proximate the first end of the side wall, the joint including an upper portion and a lower portion. Additionally, an opening is formed in the top wall, wherein the opening is located below the upper portion of the joint.

Preferably, the joint comprises a polymer-to-polymer bond. Alternatively, the joint comprises an adhesive.

In certain constructions, the joint has a first cross sectional thickness and the top wall has a second cross sectional thickness, the first cross sectional thickness being greater than the second cross sectional thickness. It is envisioned that the first cross sectional thickness can be at least twice the second cross sectional thickness.

It is envisioned that the top wall is formed from a first blank and the side wall is formed from a second, separate blank.

Preferably, the side wall circumferentially extends about the longitudinal axis, and wherein the top wall is substantially perpendicular to the longitudinal axis.

In certain constructions, at least one of the side wall and the top wall is formed from a paper-based material selected from the group consisting of paperboard, corrugated board, cardboard, and combinations thereof.

The present disclosure is further directed to a container-lid assembly that includes a container having a rim; and one of the previously described container lids positioned over the container such that the rim is received in the outwardly projecting sealing channel.

Preferably, the container is a drinking cup. It is envisioned that the rim is a rolled rim.

The present disclosure is further directed to a container lid that includes a side wall and a top wall. The side wall is formed from a first piece of paperboard and extends about a longitudinal axis and includes longitudinally opposed first and second ends. The side wall defines a sealing channel between the first end and the second end, the sealing channel having an outer diameter. The top wall is formed from a second piece of paperboard and is connected to the first end of the side wall along a joint, wherein the sealing channel is located between the joint and the second end. The side wall includes a flared portion positioned between the sealing channel and the second end, a maximum inside diameter of the flared portion being greater than the sealing channel outer diameter.

Preferably, the top wall is formed from a first blank and the side wall is formed from a second, separate blank. In certain constructions, the side wall circumferentially extends about the longitudinal axis, and wherein the top wall is substantially perpendicular to the longitudinal axis.

Still further, the present disclosure is directed to a lid for a container that includes, among other elements, a paperboard side wall and a paperboard top wall. The paperboard side wall is formed from a first blank, wherein the side wall extends about a longitudinal axis and includes longitudinally opposed first and second ends. The paperboard top wall is formed from a second blank, wherein the first blank is different from the second blank. The top wall is connected to the side wall proximate the first end and the side wall includes an in-curled rim portion associated with the first end.

BRIEF DESCRIPTION OF THE DRAWINGS

So that those having ordinary skill in the art to which the present invention pertains will more readily understand how to employ the systems and methods of the present invention, embodiments thereof will be described in detail hereinbelow with reference to the drawings, wherein:

FIG. 1 illustrates one embodiment of the disclosed lid 10 wherein the top wall 11 of the lid is recessed and includes an opening or opening structure 15.

FIG. 2 illustrates several embodiments of a lid wherein the top wall of the lid is recessed and a lower skirt 19 is provided.

FIG. 3A again illustrates the lid, while

FIG. 4A illustrates a step in forming the side wall of the lid, while

FIG. 5A illustrates a further step in forming the side wall of the lid, while

FIGS. 6A to 6C illustrate steps in combining the side wall and top wall to form the lid;

FIG. 14 illustrates a further embodiment of the disclosed lid 110 wherein the top wall 111 of the lid is recessed and includes an opening or opening structure 115.

Figure 1A:
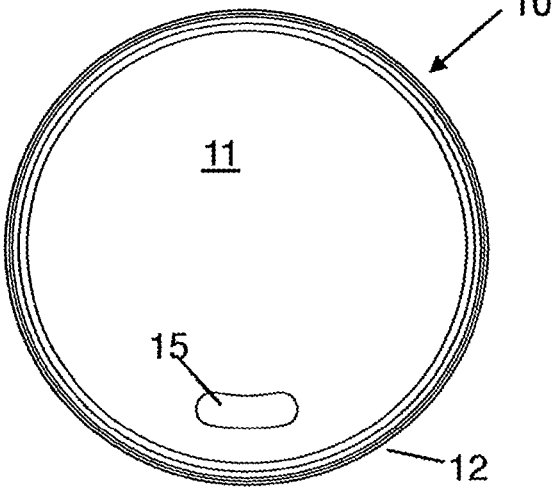
FIG. 1A is a plan view of the lid.

These and other aspects of the subject invention will become more readily apparent to those having ordinary skill in the art from the following detailed description of the invention taken in conjunction with the drawings.

DETAILED DESCRIPTION OF PREFERRED EMBODIMENTS

Disclosed herein are detailed descriptions of specific embodiments of the paper-based container lids, methods and assemblies of the present invention. It will be understood that the disclosed embodiments are merely examples of the way in which certain aspects of the invention can be implemented and do not represent an exhaustive list of all of the ways the invention may be embodied. Indeed, it will be understood that the systems, devices and methods described herein may be embodied in various and alternative forms. The figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

The present disclosure now will be described more fully, but not all embodiments of the disclosure are necessarily shown. In addition, many modifications may be made to adapt a particular situation or material to the teachings of the disclosure without departing from the essential scope thereof.

The paper-based container lid of present disclosure includes, among other elements, a top wall and a side wall. The side wall includes a first end and a second end, the first end connecting to the top wall. The side wall further including a sealing channel for sealingly engaging a rim of the container and securing the lid to the container, wherein the top wall and the side wall are formed from separate blanks.

The disclosed lid provides a cover for the container to inhibit spillage and may reduce heat transfer between the packaged contents and the surrounding atmosphere. The disclosed lid may be manufactured economically using modified existing converting machines (or custom-built machines) for the production of containers, such as cups or bowls, wherein each container is made of at least two main components: a bottom wall of the container and a side wall of the container. The lid of present disclosure may be formed in the similar manner as the container, namely the lid is made of at least two main components (a top wall and a side wall).

The disclosed paper-based lids may be used with containers of various types. They may be used for fluid containers, such as cups or bowls.

In one embodiment, the container is a drinking cup. In one embodiment, the lid is for disposable cups of the type commonly used as carry-out containers for beverages such as coffee and the like. Such cups are commonly made of Styrofoam or paper. In one embodiment, the disclosed lid is for the drinking cup containing hot fluid, such as coffee cup.

In one embodiment, the container is a drinking cup having a generally circular upper rim with a bead formed on it. Those skilled in the art will readily appreciate that the lids disclosed herein can be adapted for use with containers having rims which are not circular, but may be other shapes, such as, but not limited to, rectangular.

The top wall of the lid provides coverage for the contents inside the container. The side wall of the lid provides an engagement to the container, a seal to prevent leakage of packaged fluid/contents, and structural rigidity. The sealing channel formed in the side wall mechanically secures the lid in place to the container and provides a seal between the lid and the container. The sealing channel is sized to fit the container rim, providing a snug friction fit between the lid and the container. Although the sealing channel is shown in representative figures as a curved channel, one skilled in the arts appreciates that the radius or cross-section of sealing channel may be modified to accommodate the shape of the container rim. For example, the cross-section of sealing ring may be square, rectangular, oval, or oblong.

As described herein below, in certain embodiments the container is a drinking cup and the lid may include at least one opening structure to enable drinking from the cup without removal of the lid. The opening structure may be formed in the top wall of the lid. In one expression, the top wall of the lid may further include a recess adjacent the opening structure to accommodate the upper lip of the user drinking from the cup.

A variety of opening structures may be used for the lid of present disclosure. In one embodiment, the drinking opening structure may be a cut out structure. In one embodiment, the drinking opening structure may be score lines defining a movable portion that the user could penetrate or fold to gain access to the interior of the cup.

In one embodiment wherein the container is a drinking cup, the disclosed lid may include a vent hole formed on the top wall, such as near the center of the top wall, to enable air to flow into the cup as the user drinks from the cup to facilitate the flow of liquid out of the cup through the drinking opening structure.

The top wall of the disclosed lid may have out-of-plane features for positioning the drinking opening structure, for appearance, to contain liquid that ends up above the lid and drain it back into the cup, or for combinations of these reasons. The top wall may include a debossed (i.e., depressed) feature which surrounds the drinking hole. Additionally, the top wall may include an embossed (raised) feature or features (not shown). The top wall may include both depressed and raised features. Such depressed or raised features may be formed in the top wall either in the blank (flat) stage of FIG. 3C, or in the intermediate formation stage shown in FIGS. 4B and 5B, or during or after assembly as shown in FIGS. 6B and 6C.

Various connection methods may be used in the present disclosure to join the lid top wall and the first end of the lid side wall. Examples of such connections may include, but are not limited to, a lap-joint, a wrapped edge, or combination thereof. Bonding may be achieved with a poly-poly heat seal and/or an adhesive. The lid side wall may be formed from a first blank, and the lid top wall from a second blank separate from the first blank. By "joint" in the present disclosure is meant the area where two originally separate pieces or blanks of material are united or connected together.

When desired, the second end of the lid side wall may include a rolled or folded edge to provide stability and alignment when sealing the disclosed lid to the container.

In one embodiment, the disclosed lid may include an outward skirt structure to facilitate the engagement of the lid onto the container. As the lid is pushed downwardly onto the rim of the container, the skirt structure aids in centering the lid and in engaging the sealing channel with the container rim. Furthermore, the skirt may provide a contact surface for removing the disclosed lid from the container.

The present disclosure also describes an apparatus that includes:

a die for receiving a container or a container lid, the die including an annular recess formed in an internal surface thereof, a channel forming tool including a protruding structure having a shape complementary with the annular recess of the die, the protruding structure cooperating with the annular recess of the die and engaging a portion of the sidewall of container or the container lid, whereby when the channel forming tool is placed inside the container or the container lid positioned in the die, the protruding structure of the tool presses at least a portion of the container or container lid into the recess such that a sealing channel is formed on the container or container lid where the protruding structure abuts the annular recess, and wherein either the die, or the channel forming tool, or both are rotated during the formation of sealing channel. In one embodiment, the portion of the container or the lid being engaged by the channel forming tool includes a side wall of the container or the lid.

The disclosed apparatus is suitable for forming a sealing channel in a container or a container lid that provides an enhanced sealing between the container and the lid.

The disclosed apparatus may be adapted to be fitted to the converting machines commonly used for the production of containers or container lids.

The depth, shape and the width of the sealing channel may be adjusted to accommodate the end use applications of the containers. These may be achieved by modifying the depth, shape and the width of the protruding structure on the channel forming tool. The disclosed apparatus may provide a sealing channel with increased depth to allow for an improved sealing between the container and the lid.

The disclosed apparatus may be used for the containers and/or container lids of various types. The containers may be for fluid containers, such as cups or bowls.

In one embodiment, the container is a drinking cup having a generally circular upper rim with a bead formed on it. Paperboard drinking cups may typically have a rolled bead on their upper edge. However, the disclosed lid may also be used for cups made from other materials which may have different forms of an upper rim, such as a molded rim for a Styrofoam cup.

Referring now to the drawings wherein FIG. 1 illustrates one embodiment of the disclosed container lid which has been identified using reference numeral 10. Lid 10 includes a top wall 11 and a side wall 12, which may be formed as separate pieces and then connected together to form the lid 10. The side wall 12 may extend (e.g., circumferentially extend) about a longitudinal axis L (FIG. 1B), and may include a first end 13 longitudinally opposed from a second end 14. The top wall 11 may be transverse to the longitudinal axis L, and may be connected to the first end 13 of the side wall 12 at a joint section 18 to form the lid 10.

Figure 13A:
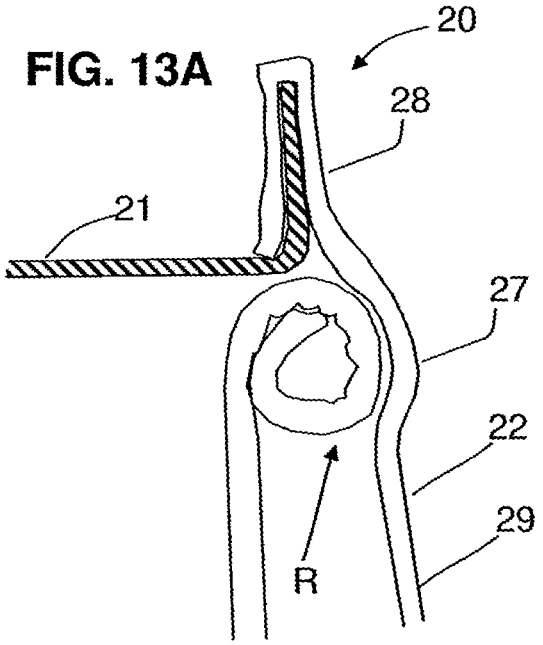
FIGS. 13A to 13D illustrate cross sections of several types of cup lids.

The side wall 12 of the lid 10 may include a sealing channel 17, which continuously (e.g., circumferentially) extends about the side wall 12. Those skilled in the art will readily appreciate that sealing channel 17 can be discontinuous without departing from the scope of the present invention. The sealing channel 17 is sized and shaped to closely receive the rim "R" of a container, as shown in FIG. 13A, thereby securing the lid 10 to the container.

Figure 1B:
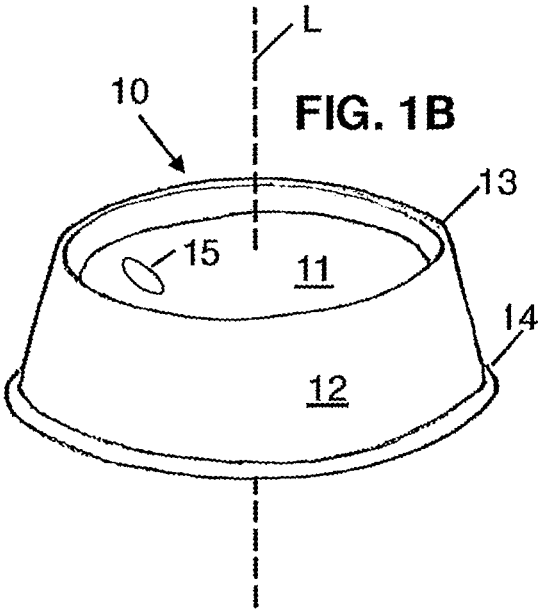
FIG. 1B is a perspective view.
Figure 1C:
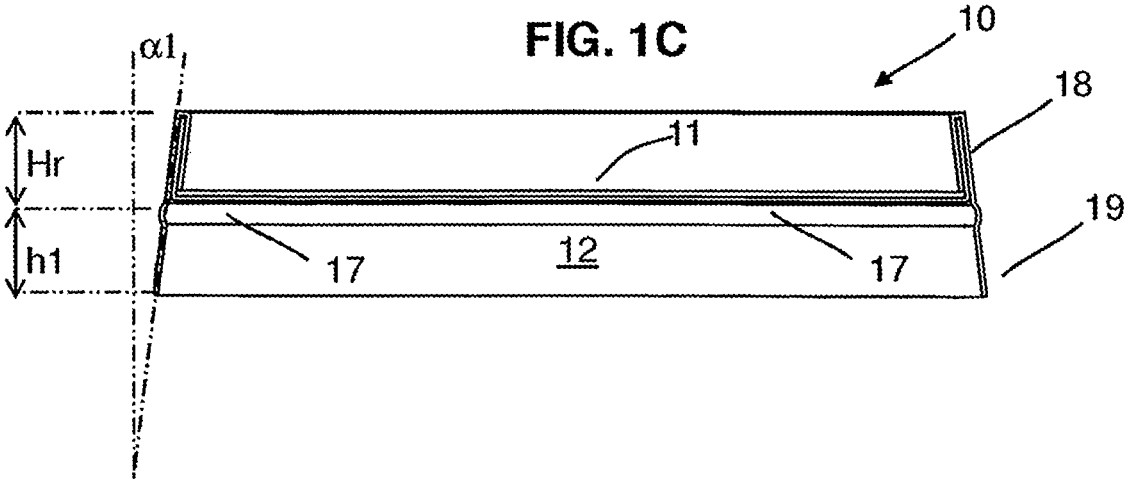
FIG. 1C is a cross sectional view showing the sealing channel 17 and the joint section 18 between the top wall 11 and the side wall 12 of the lid.
Figure 1D:
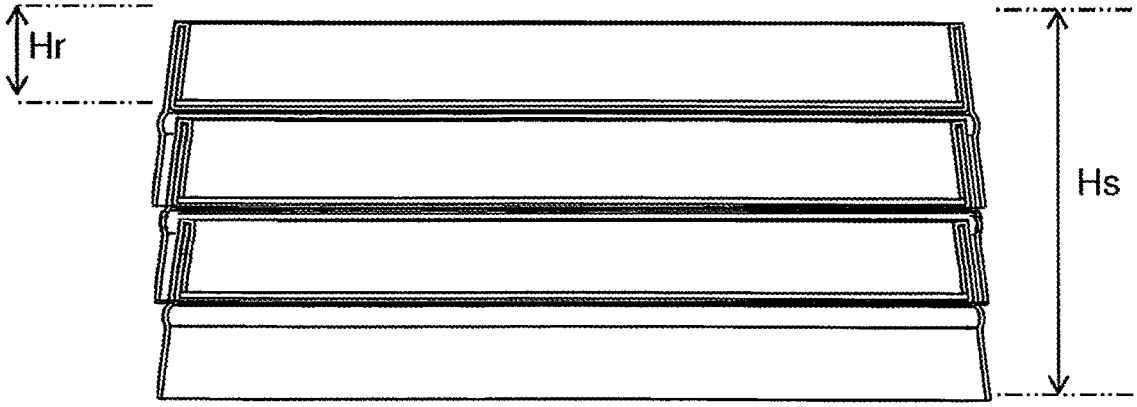
FIG. 1D is a cross sectional view showing a stack of three lids.

Referring to FIGS. 1A and 1B, the top wall 11 may include an opening 15 that provides an access to the contents inside the container without removal of the lid. As shown in FIGS. 1B-1C, the top wall 11 may be formed such that the top wall surface is lower than the joint section 18 of the top wall 11 and the side wall 12. As shown in FIG. 1C, the side wall 12 may slope outward at an angle $\alpha 1$, which may help with putting the lid on a cup, and may allow better stacking of the lids as shown in FIG. 1D. The height Hs of the stack may be determined in large part by the rim height Hr. The rim height Hr and skirt height h1 may be chosen according to manufacturing preference. In one example, the rim height Hr may be approximately 5 mm and the skirt 19 height h1 approximately 21 mm. The angle $\alpha 1$ may be chosen according to manufacturing preference. In one example, $\alpha 1$ may be about 7 degrees.

Figure 2A:
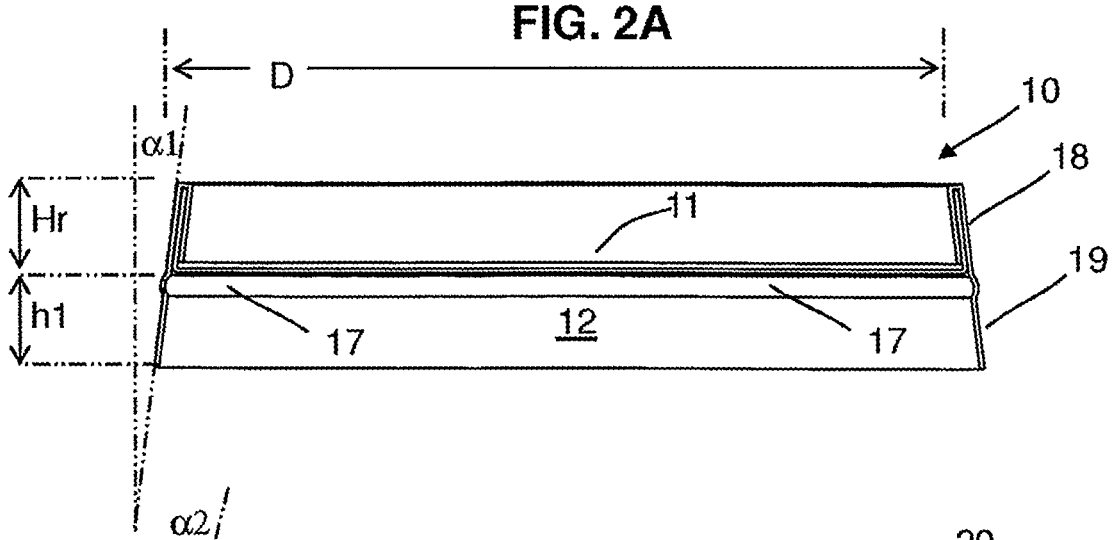
FIG. 2A is a cross section view of the lid shown in FIG. 1.
Figure 2B:
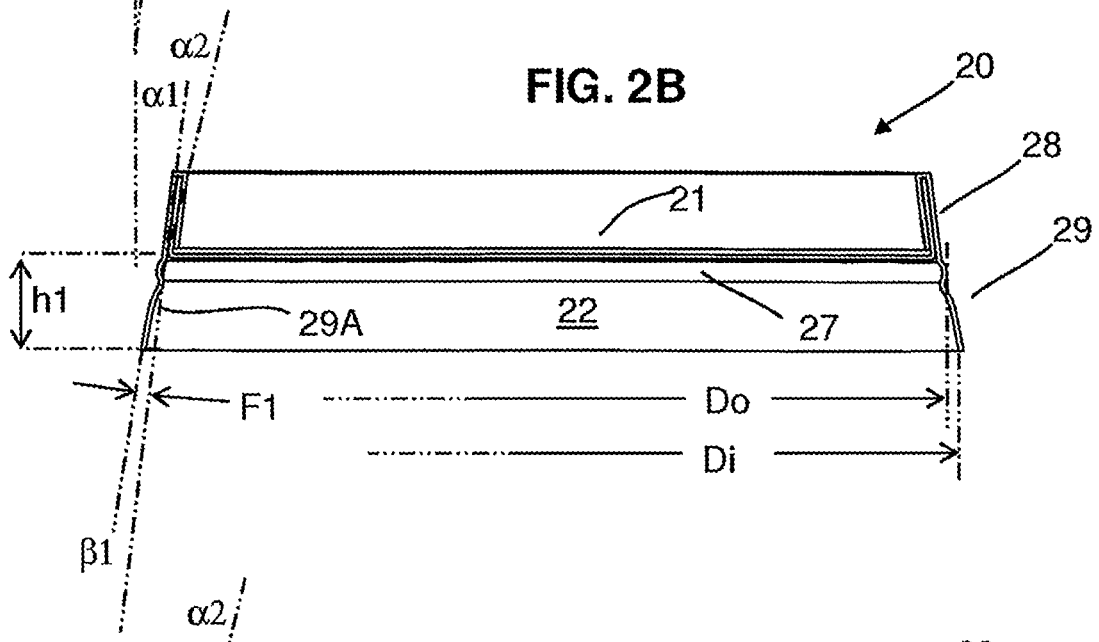
FIG. 2B is a cross section of a lid 20 with a flared or bell-shaped skirt 29, for example formed by forming the skirt outward at point 29A or lower.
Figure 2C:
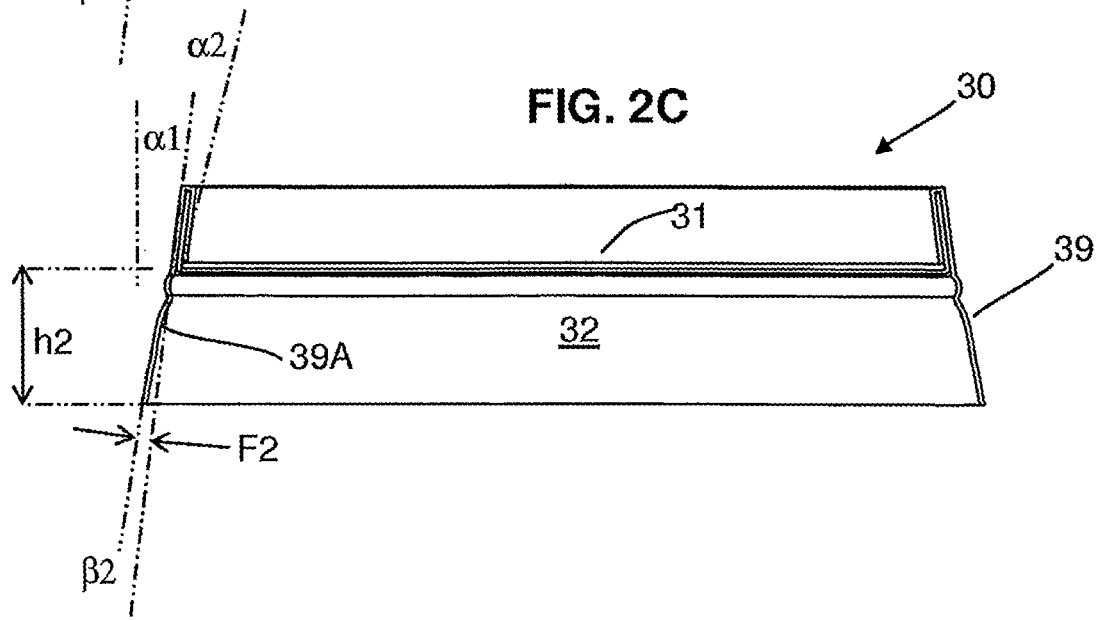
FIG. 2C is a cross section of a lid 30 with a top 31 and a lengthened and flared or bell-shaped skirt 39, for example made by forming the skirt outward at point 39A or lower.

FIG. 2A again illustrates lid 10. FIG. 2B illustrates a lid 20 with a side wall 22 having a flared skirt 29, and FIG. 2C shows another lid with a longer side wall 32 also flared. By "flared" is meant that the side wall 22 is belled radially outward beyond the usual slope $\alpha 1$ of the side wall. For example, the flared side wall skirt 29 may extend generally at a flare angle $\beta 1$ relative to the side wall slope angle $\alpha 1$. In other words, while the joint 28 may slope inwards at an acute angle $\alpha 1$ relative to the top wall 21, the flare portion 29 may have a slope angle $\alpha 2$ that is greater than $\alpha 1$. The angle $\alpha 2$ may be approximately $\alpha 1+\beta 1$.

As shown in FIG. 2B, the diameter Di of the inside of the flare should be greater than the diameter Do of the outside of the sealing channel 27, so that the flare and the sealing channel are not in contact with each other. This may reduce friction or sticking between the lids. Friction or sticking is inconvenient to the user, and may result in a variable stacking height for the lids. With reduced friction between lids, the stack height Hs can be more consistent (at approximately Hr times the number of lids in the stack). The sealing channel may be located just below the top wall as shown in FIG. 2, or it may be located further downward from the top wall.

Figure 9A:
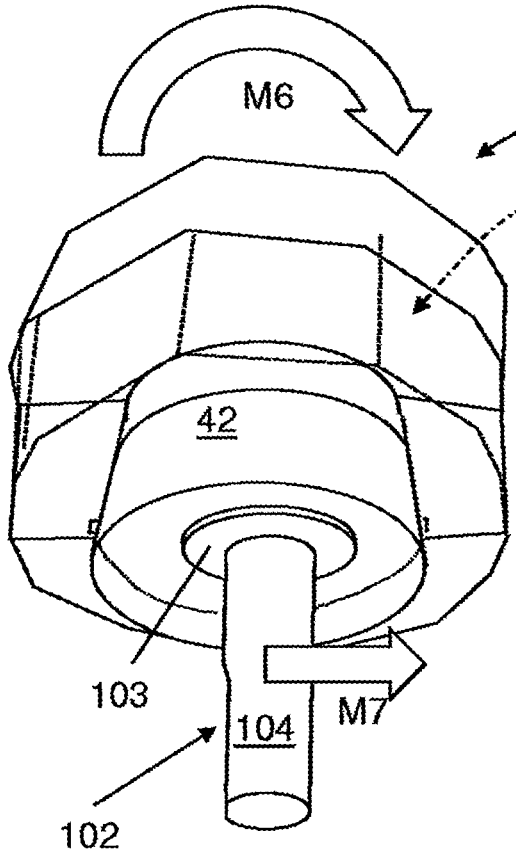
FIGS. 9A and 9B illustrate tools being used to form certain features on the side wall of the lid.

The seam (see area S in FIGS. 3A, 4A, 5A) of the side wall 22 (i.e., the area where the material overlaps to form a lap joint) may be compressed so that the step height (difference in thickness) at the joint is minimized. Minimizing the step height will minimize the potential for leakage in the channel in the area of the seam. Such seam compression may be done while the side wall is being shaped (e.g. FIG. 5A) or while the sealing channel is being made (e.g. FIG. 9A for example). One way to achieve relatively constant side wall thickness is to pass the side wall 22 (e.g. at FIG. 5A) between a pair of rollers separated by a set gap approximately equal to the board thickness. Thus, most of the side wall thickness may be relatively undisturbed (at a single thickness) but the otherwise double thickness at seam S may be reduced to near or equal to about 1.5 times a single thickness). Another way to achieve relatively constant wall thickness at seam S is to preferentially press or clamp the seam area. The overlap area may also be skived (at least one layer being thinned) to help reduce its thickness.

Figure 3A:
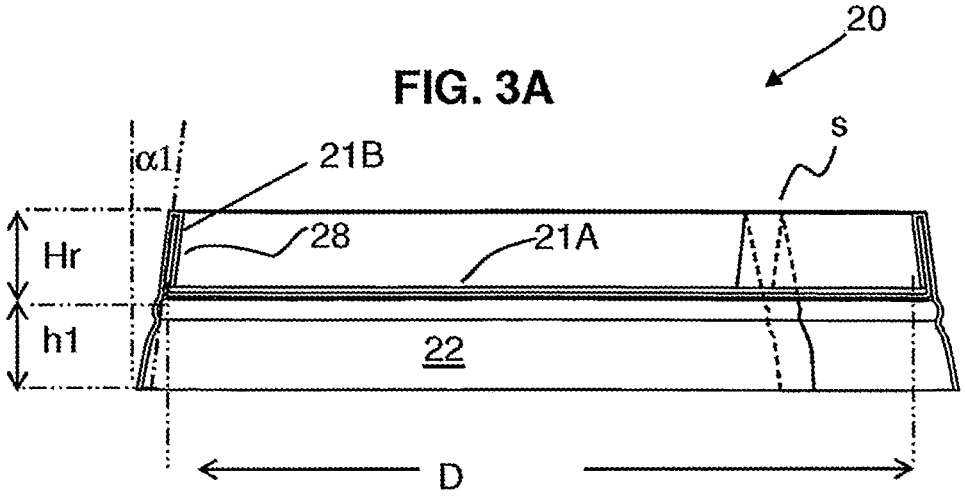

FIG. 3A shows an embodiment of the disclosed container lid similar to that in FIG. 2B. Lid 20 includes a top wall 21 and a side wall 22 that includes a first end 23 and a second end 24. As shown in FIG. 3, the top wall 21 includes a cover 21A and a vertical wall 21B extending upward from the cover 21A, and the vertical wall 21B is received and sealed between two plies of the side wall 22 at its first end 23 as joint section 28 to form a lid 20. The top wall may include an opening (see 15 in FIG. 1) that provides an access to the contents inside the container without removal of the lid. The joint section 28 may thus have three plies. The joint section may 28 have a cross sectional thickness greater than the cross sectional thickness of either top wall 21 or side wall 22. The joint section 28 may have a cross sectional thickness at least twice the thickness of either of the top wall 21 or the side wall 22.

Figure 3B:
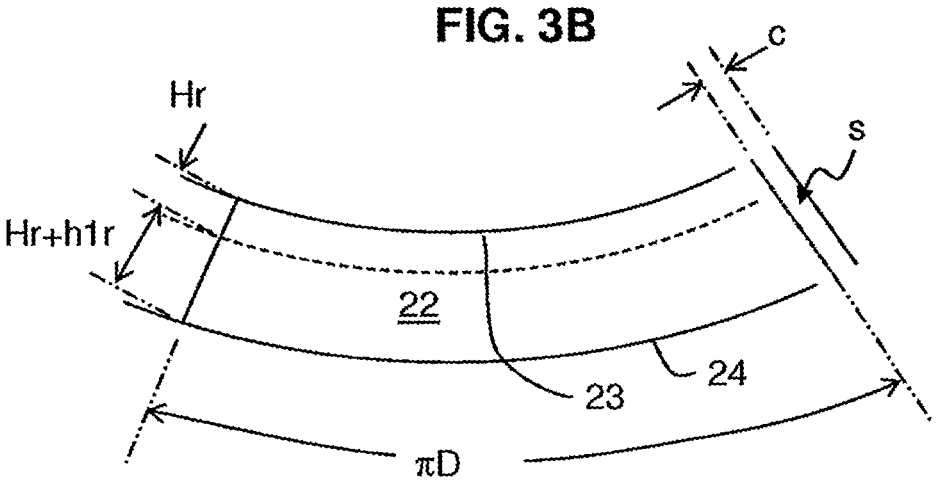
FIGS. 3B and 3C illustrate blanks for the side wall and top wall of the lid.

FIG. 3B shows an example blank for making the side wall 22. For a lid having a diameter D, rim height Hr, and skirt height h1, the side wall blank may have a length of about πD, and a width of about h1+2Hr. An overlap distance C may be provided at an end of the blank for forming a longitudinal seam. The side wall 22 may be made from paperboard, such as a paperboard cup stock. As a non-limiting example, the caliper may be about 16.5 mils (0.016"). The paperboard may lack any clay coating, and may be coated on each side with about 0.75 mils to 1.0 mils of LDPE (low density polyethylene). In one embodiment, no additional heat sealing or adhesive components are used besides the LDPE and any associated tie layer(s).

Figure 3C:
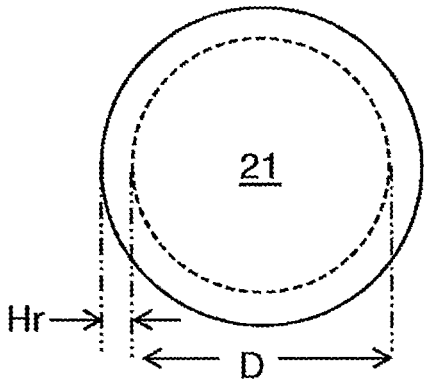

FIG. 3C shows a circular blank for making the top wall 21. For a lid with a diameter D and rim height Hr, the diameter of the blank may be approximately D+2Hr. The top wall 21 may be made from paperboard, such as a paperboard cup stock. As a non-limiting example, the caliper may be about 9.3 mils (0.0093"). The paperboard may lack any clay coating, and may be coated on the side to face the inside of the cup with about 0.75 mils to 1.0 mils of LDPE (low density polyethylene), and on the outer side with about 0.5 mils to 1.0 mils of LDPE. In one embodiment, no additional heat sealing or adhesive components are used besides the LDPE and any associated tie layer(s).

Figure 4A:
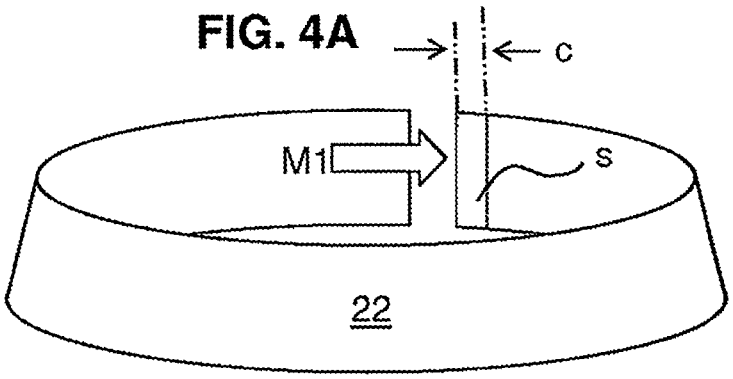
Figure 4B:
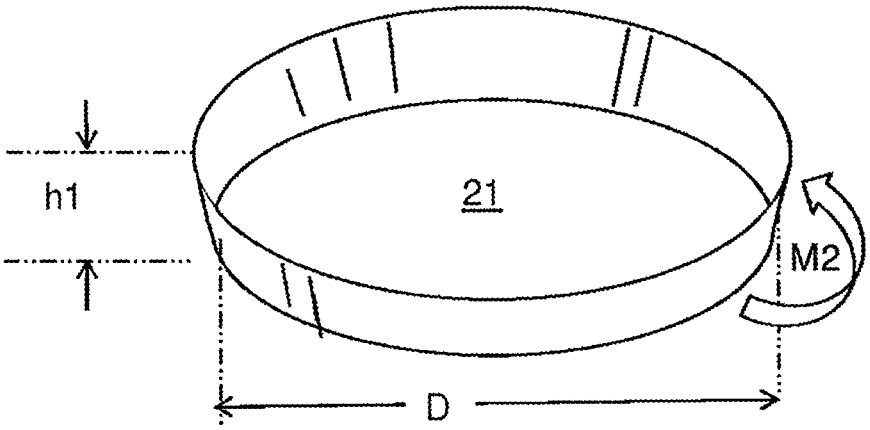
FIG. 4B illustrates a step in forming the top wall of the lid.

FIG. 4A shows a step in forming the side wall 22 of the container lid by bringing together (arrow M1) the ends of the side wall blank of FIG. 3B, to form a band or loop. This may be achieved, for example, by wrapping the side wall blank around a cone shaped mandrel and adhering the ends together, such as with an adhesive or heat. FIG. 4B shows a step in forming the top wall wherein the top wall 21 of the lid by turning upward (arrow M2) the perimeter of the circular blank. This may be achieved, for example, by placing the top wall 21, in the form of a disk, over a circular opening or circular cavity and using a pressing tool or vacuum to press or draw the interior area of the disk into the opening or cavity.

Figure 5A:
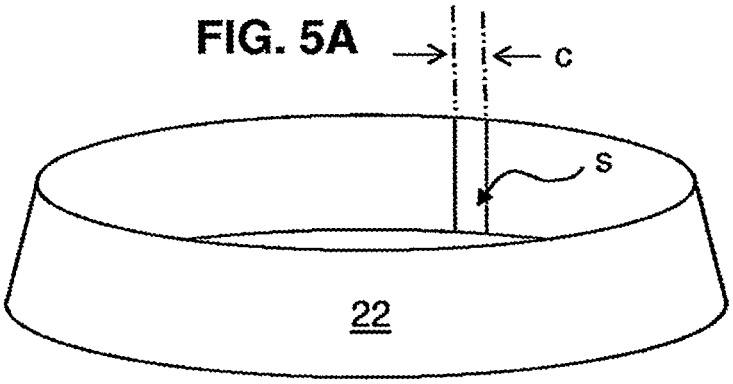
Figure 5B:
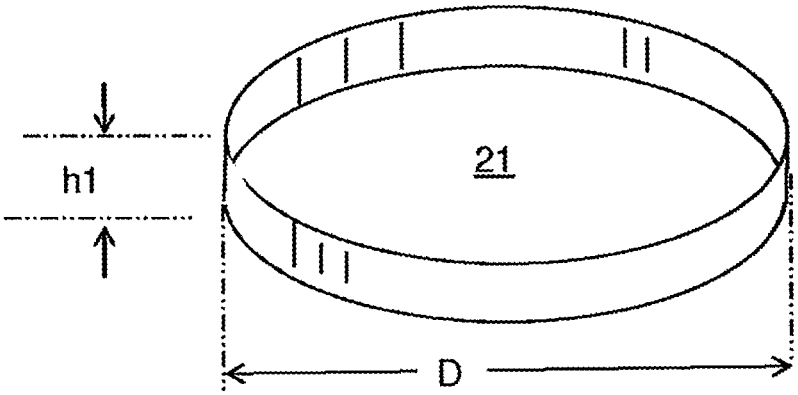
FIG. 5B illustrates a further step in forming the top wall of the lid.

FIG. 5A shows a further step in forming the side wall 22 of the container lid by overlapping the ends of the side wall blank of FIG. 4B, along seam area S, which may overlap a distance C. FIG. 5B shows an optional further step in forming the top wall wherein the top wall 21 may be turned upward about 90 degrees (or even slightly further to match the slope angle of the side wall.

FIG. 6A shows a further step in forming the lid where the top wall 21 is moved (arrow M3) upward inside the loop of the side wall 22, where (as shown in FIG. 6B for this example) the plane of the top wall 21 may be about ⅓ up from the bottom of the side wall 22 and about ⅔ down from the top edge of the side wall 22. Next, the top edge of side wall 22 may be folded down and inward (arrow M4) over the upstanding perimeter of the top wall 21. This may be achieved, for example by using rollers or other tools to bend the top edge inward and downward, and then using a pair of wheels to press the folded top edge of the side wall into tight sealing contact with the upstanding perimeter of the top wall as shown by arrows M5 in FIG. 6C. The resulting structure is shown in FIG. 6C. The triple layer of the rim of the lid may be sealed together by heat and pressure and/or adhesive and pressure.

Figure 7A:
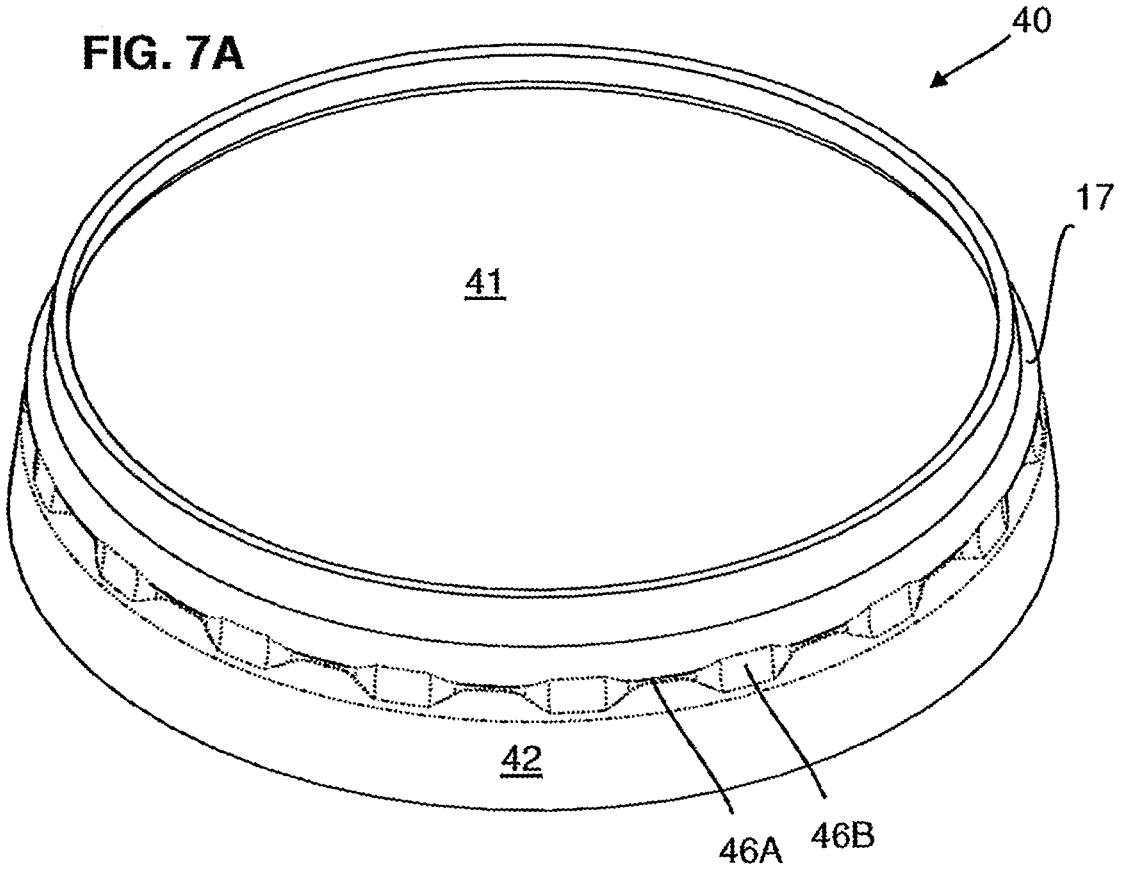
FIGS. 7A and 7B illustrate a perspective view and a cross section view of a lid showing additional features.
Figure 7B:
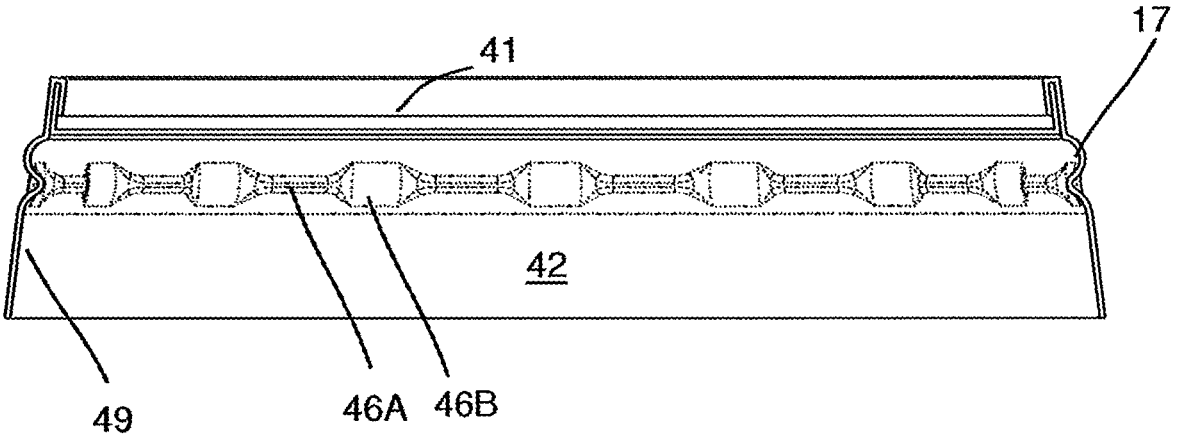

FIGS. 7A and 7B show a variation on the lid 40 where indents are formed in the side wall 42. The indents may include formed areas 46A and 46B that are formed inwardly and outwardly with respect to one another. An alternate description of the indents is that the inward formed areas 46A are inwardly formed creases, while the outward formed areas are columnar regions positioned at a larger radius than the inwardly formed creases. While the upper boundary of the sealing channel 17 may thus be a continuous circle as shown, the lower boundary may be a discontinuous series of arcs joined by the columnar regions. When the lid 40 is placed onto a cup, downward pressure may be applied to seat the sealing channel onto the cup. The columnar regions 46B may serve to prevent the sealing channel 17 and/or regions 46A from being crushed or collapsed by this pressure.

Lid 40 may also have a flared side wall 49 as described previously.

When appropriate, the surface of the disclosed lid may be made from paperboard coated with various materials to impart desired properties. For example, the lid may be made of water-resistant coated paper such as a poly-coated paper or board. The coating may be applied in advance, for example on-machine or on-coater. The poly-coated surface may face inwardly (toward the contents which the lid would cover) or the poly coating may be on both surfaces. The paperboard itself may be chemically sized to minimize wicking of liquids including but not limited to hot coffee or other hot liquids.

In one embodiment, the disclosed paper-based lid may include a polymeric-based coating on one side or both sides. The polymer coating may impart liquid resistance to the paper and may facilitate sealing the top wall to the side wall. A heat sealable coating may be used. Optionally a clay coating or other coating may be provided. Such coatings may provide useful properties, such as improved printing characteristics for printing customer information or other indicia on the lid.

Various paper-based substrates may be used for the top wall of the disclosed lid. Examples of such materials include, but are not limited to, paperboard, and combinations of paperboard with other materials.

Various paper-based substrates may be used for the side wall of the disclosed lid. Examples of such materials include, but are not limited to, paperboard, and combinations of paperboard with other materials.

In one embodiment, the top wall and the side wall of the disclosed lids are made of the same type of the substrate.

In one embodiment, the top wall and the side wall of the disclosed lids are made of different types of the substrates.

Figure 8A:
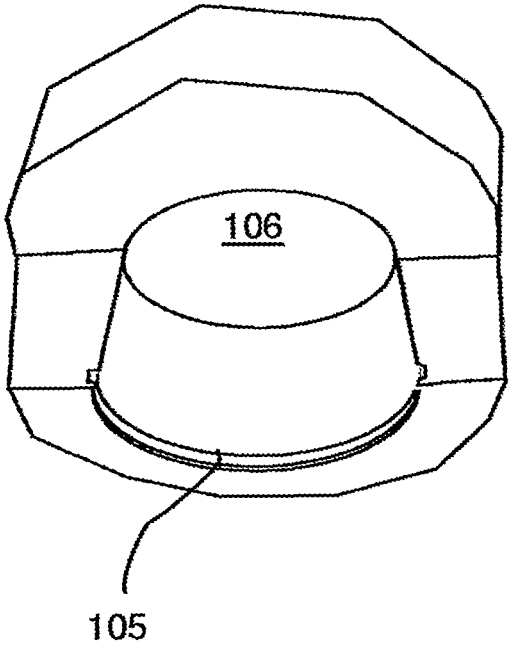
FIGS. 8A and 8B illustrate tools for forming certain features on the side wall of the lid.
Figure 8B:
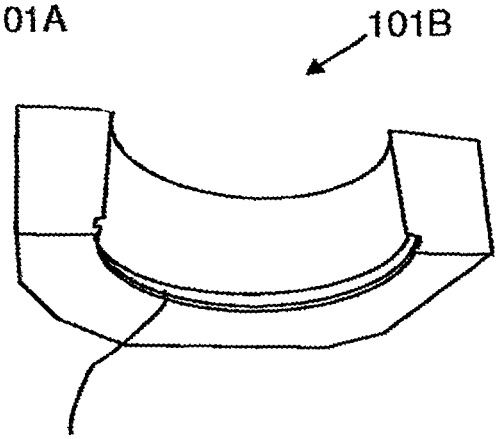
Figure 8B:
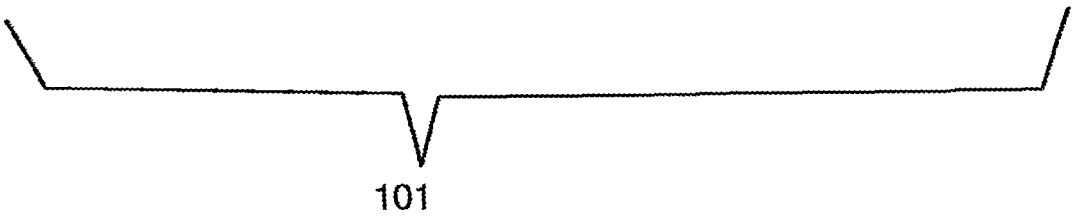
Figure 9B:
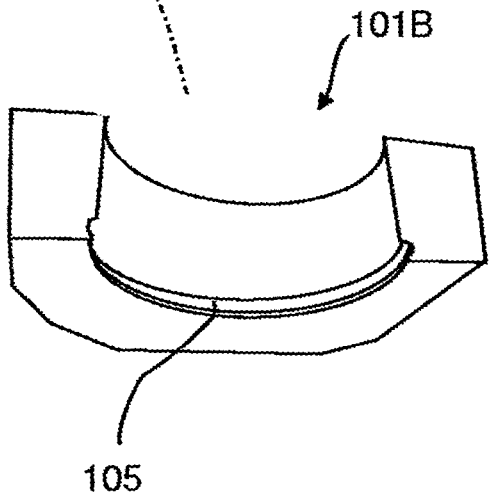

FIGS. 8 and 9 show one embodiment of an apparatus for forming a sealing channel in a cup lid. The apparatus includes a supporting die 101 for receiving a container or a container lid, a channel forming tool 102 that includes an annular protruding structure 103, and a rotating tool 104.

The supporting die may include more than one component to facilitate the removal of the container or lid from the die after the sealing channel is formed thereof. In FIG. 8, the supporting die 101 includes components 101A and 101B that may be assembled together to receive the container or lid, and may be easily disassembled to facilitate the removal of the container or lid from the supporting die 101. It is understood that the supporting die may include more than two components, and the present disclosure is in no way limited to only the apparatus with the supporting die composed of two components as shown in FIG. 8.

Referring to FIGS. 8 and 9, the supporting die 101 includes an annular recess 105 formed in its internal surface, wherein the annular recess 105 has a complementary shape to that of the outer edge of the protruding structure 103 on the channel forming tool 102.

FIG. 8 shows the apparatus not yet holding the cup side wall 42 or channel forming tool, which are added in FIG. 9. The lid may be held in the tool by vacuum or by gripping fingers (not shown). The channel forming tool suitable for use in the disclosed apparatus may include one or more protruding structures. FIG. 9 shows the channel forming tool 102) with only one annular protruding structure 103). However, one skilled in the art recognizes that the channel forming tool of the disclosed apparatus may include more than one protruding structure.

The disclosed apparatus may include a moving tool to rotate the container or the container lid. FIG. 9 shows one embodiment of the disclosed apparatus wherein the supporting die 101A, 101B rotates (arrow M6) the lid (side wall 42, shaded) while channel forming tool 102 is moved (arrow M7) so that the annular protruding structure 103 contacts the lid side wall 42 to gradually displace the side wall into the annular recess to form the desired sealing channel. The annular protruding structure 103 as shown here may be a disk-shaped wheel that may be rotated by contact with the channel forming tool 102, or the protruding structure 103 may rotate on a bearing upon channel forming tool 102. In other embodiments the annular protruding structure 103 may not rotate or may rotate in synchronization with the moving tool.

The supporting die 101A, 101B may be rotated in a milling machine, and the channel forming tool 102 moved relative to the work on the milling machine slide or table. Use of a milling machine may be practical in testing situations. Instead of using a milling machine, and/or for production, any equipment that provides the desired actions may be used to produce the lid. Automated equipment may be utilized.

Although the apparatus is shown with rotation M6 about a horizontal axis, rotation could also be about a vertical or other axis. Although the axis of the channel forming tool 102 (or rotating tool) is shown to be parallel to the axis of rotation M6, there may be instances where the channel forming tool 102 and/or tool 104 are at an angle to the axis of rotation M6. For example, if it is desired to form the sealing channel close to the lid top 41, the channel forming tool 102 and/or tool 104 may be held at an angle so that annular protruding structure does not rub on the lid top 41, or contact any depressed (inward) features that may optionally be present on the lid top 41. Instead of, or in addition to, using a rotating or rolling tool to form the sealing channel, the sealing channel may also be created by pressing the paperboard between a tool and a backing surface.

The annular protruding structure 103 may be moved a set distance (as with a milling machine table or slide, using markings on a lead screw or using a digital readout). Thus a set gap may be achieved between the annular protruding structure 103 and the annular recess, so that the side wall 42 at the sealing channel has a relatively uniform thickness. This may entail compressing the seam S more than the rest of the side wall.

Figure 10A:
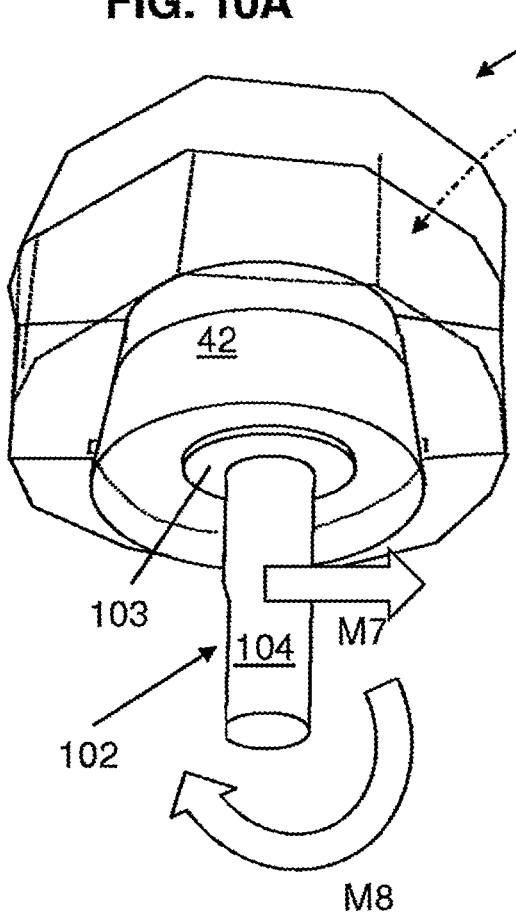
FIGS. 10A and 10B illustrate tools being used in a different mode of operation.
Figure 10B:
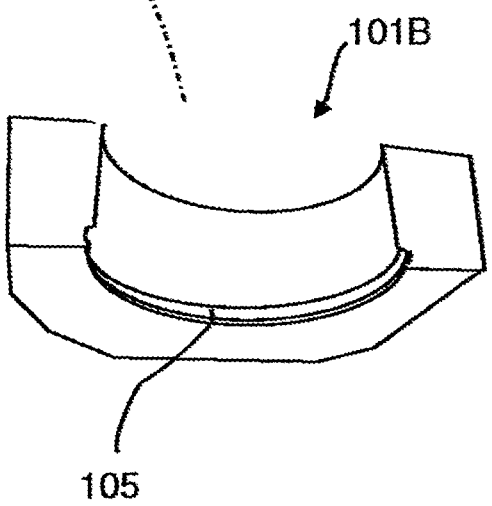

Alternately as shown in FIG. 10, the container or lid (shaded) and the supporting die 101 may remain still while the channel forming tool 102 with its annular protruding structure 103 moves and rotates (arrow M8) to gradually create a sealing channel on the container or lid.

Alternatively, in one embodiment of the disclosed apparatus, both the channel forming tool 102 and the supporting die 101 may be moved in relation to one another in any direction so long as their movements facilitate a gradual formation of sealing channel on the container or lid.

In one embodiment of present disclosure, in operation a container or a lid is positioned in a supporting die with its side wall against an internal surface of the die. Then, the channel forming tool is placed inside the container or lid against its side wall. The rotating tool moves the die, or the channel forming tool, or both in relation to one another such that the protruding structure of the channel forming tool presses a portion of the container or lid side wall abutting the recess of the die to create an annular sealing channel on the container or lid side wall. The resulting container or lid is then removed from the supporting die, either with or without a need for disassembly of the supporting die.

Figure 11A:
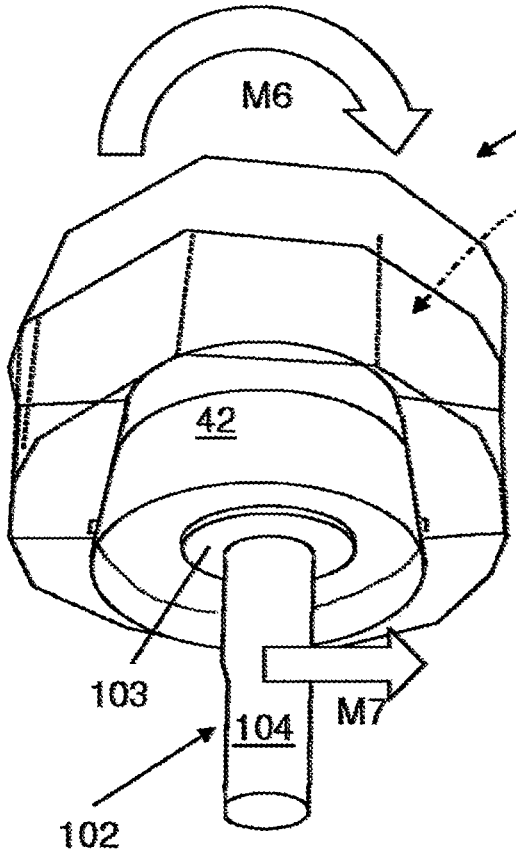
FIGS. 11A and 11B illustrate tools being used in yet another mode of operation.
Figure 11B:
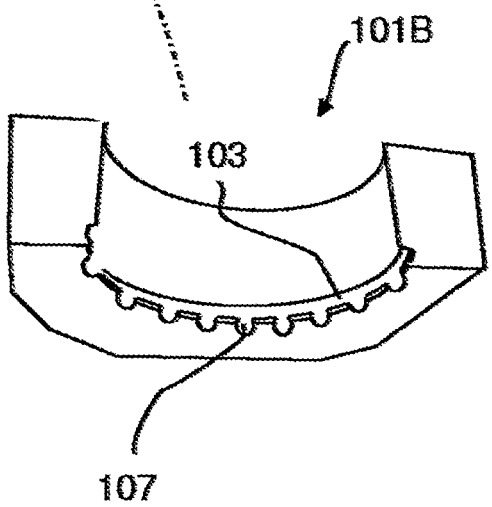

The annular protruding structure 103, instead of being a circular disk as shown in FIGS. 8-10, may be a disk which include teeth or notches (not shown). Alternately or in addition, teeth or notches may be formed on the moving tool 101A, 101B for example as shown by notches 107 in FIG. 11B formed in annular recess 105. Teeth or notches may be utilized to form indents 46A, 46B shown in FIGS. 7A, 7B. Alternately, or in addition, raised or depressed areas may be formed in the annular recess 105. However, it may be easier to form such features on the protruding structure 103. The protruding structure 103 and supporting tool 101 may be rotated in synchronization to form indents 46A, 46B.

Figure 12A:
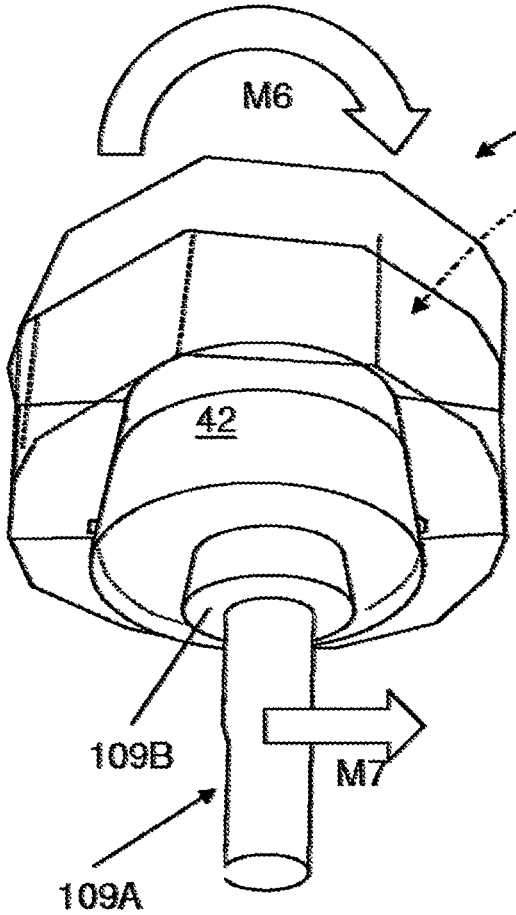
FIGS. 12A and 12B illustrate tools being used in still another mode of operation.
Figure 12B:
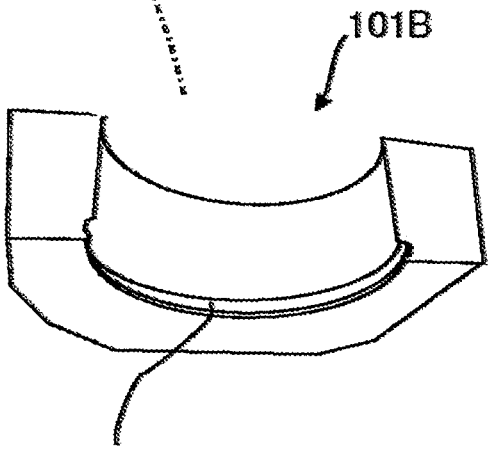

FIG. 12 shows one embodiment of the disclosed apparatus wherein the supporting die 101A, 101B rotates (arrow M6) the lid (side wall 42, shaded) while a flare forming tool 109 is moved (arrow M7) so that a conical protruding structure 109B (or other suitably shaped tool) contacts the lid side wall 42 to displace the side wall into a bell-shaped or flared edge 29 (see FIG. 2B) below the sealing channel. The bell-shaped or flared edge 29 may help guide the lid onto the cup. The flare forming tool may be rotated by contact with the channel forming tool 102 or the lid, or the conical protruding structure 109B may rotate on a bearing upon tool 109A. In other embodiments the flare forming tool 109 may not rotate or may rotate in synchronization with the moving tool. In other embodiments the supporting die 101A, 101B may have an enlarged open end to cooperate with the flare forming tool 109 in forming the flare.

FIG. 13 shows cross sections of several cup lids. FIG. 13A illustrates a cross section of the disclosed cup lid 20 seated on the rim R of a cup. The cup lid 20 includes the top wall 21 and side wall 22 joined together at joint 28. The formed sealing channel 27 fits snugly on the rim R. The side wall 22 may be flared as at 29.

Figure 13B:
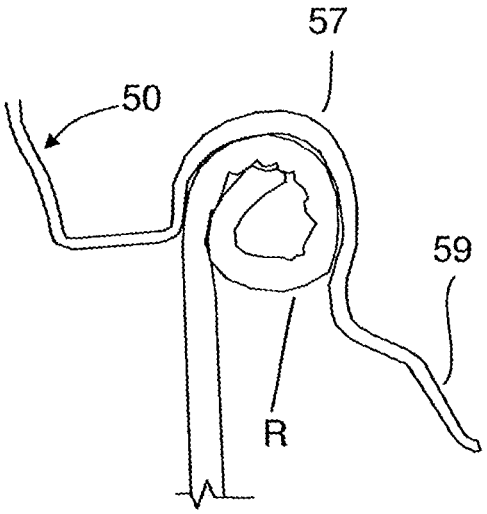
FIG. 13B (PRIOR ART)
Figure 13C:
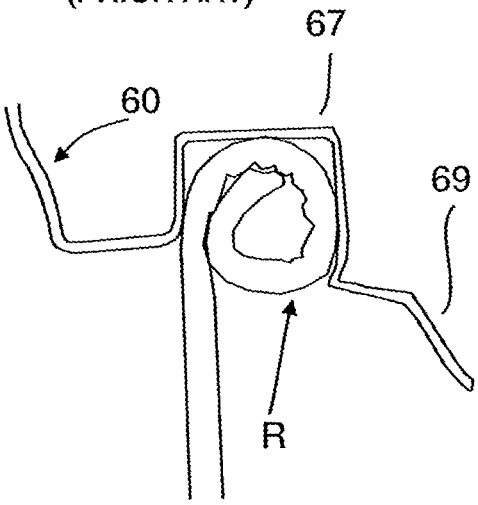
FIG. 13C (PRIOR ART)
Figure 13D:
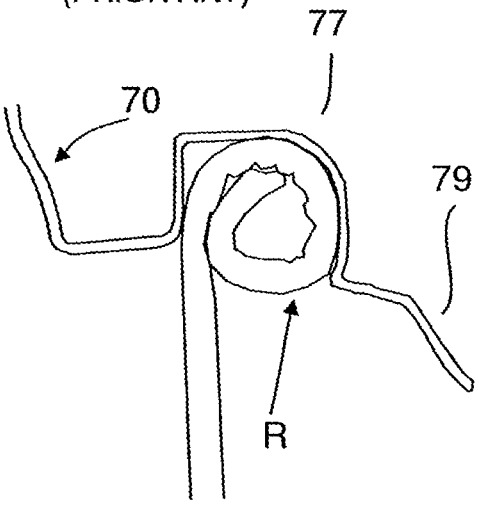
FIG. 13D (PRIOR ART)
Figure 13E:
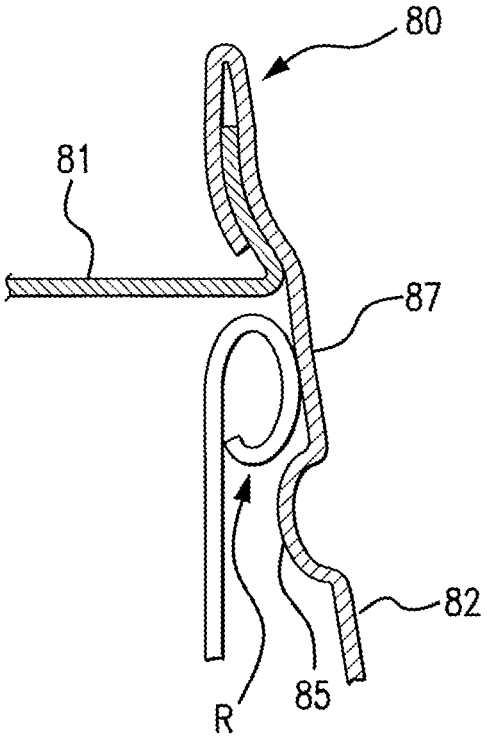
FIG. 13E (PRIOR ART)
FIG. 13E illustrates a cross section of the Inmaco lid.

FIG. 13B shows an existing plastic lid 50 that has a sealing channel 57 with an approximately circular shape, and also a flared section 59. As can be readily seem, the sealing channel is arranged the rim of the cup is inserted upward into the channel. FIG. 13C shows another existing plastic lid 60 that has a downwardly facing sealing channel 67 with an approximately rectangular shape, and also a flared section 69. FIG. 13D shows an existing plastic lid 70 that has a sealing channel 77 with an approximately rectangular shape on an inner quadrant, and an approximately circular shape on an outer quadrant, and also a flared section 79. FIG. 13E provides a cross-sectional view of the interaction between the Inmaco lid and a convention beverage cup. As noted previously, the bead formed in the sidewall around the circumference of the Inmaco lid 80 secures the lid 80 to an appropriately sized container. The fit is fairly tight radially, i.e. there is a close match between the outer diameter of the container rim and the inner diameter of the lid. However, there is not a tight fit axially; the lid can move up and down and thus it is unlikely that it provides good leak resistance. Moreover, since the sidewall of the lid in the sealing zone is flat and rim is curved there is not mating contact between the sidewall and rim surfaces, and thus the seal is poor.

In the construction of the present invention, the channel 27 formed in the sidewall 22 of the lid 20 acts against the radially outward pressure created by the rim of the cup creating an enhanced seal between the mating surfaces. The prior art embodiments shown in FIGS. 13B through 13E do not exhibit such a mechanical interaction.

Referring now to FIGS. 14A-14D there is illustrated a further embodiment of the container lid of the present disclosure which has been identified as reference numeral 100. Lid 100 includes, inter alia, a paperboard side wall 112 formed from a first blank 130 (see FIG. 15B). The side wall 112 extends about a longitudinal axis "L" and includes longitudinally opposed first and second ends 113/114. A top wall 111 is formed from a second blank 140 (see FIG. 15A). As noted previously, the blanks 130/140 can be made from the same material or they can be made from different materials. For example, in certain embodiments, the blanks are both paperboard.

Figure 14A:
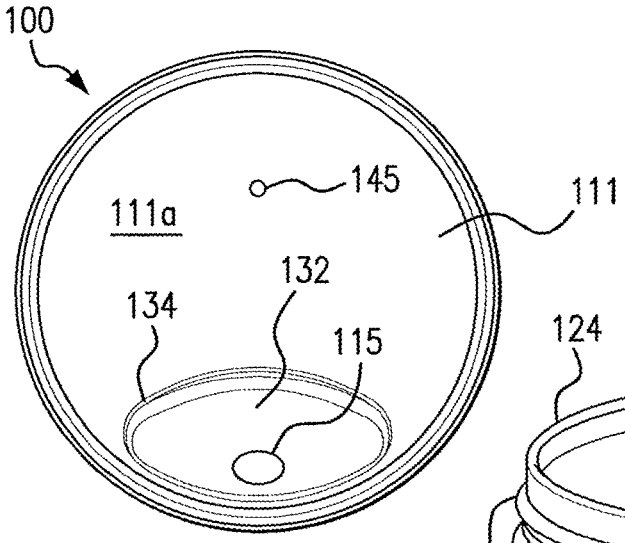
FIG. 14A is a plan view of the lid.
Figure 14B:
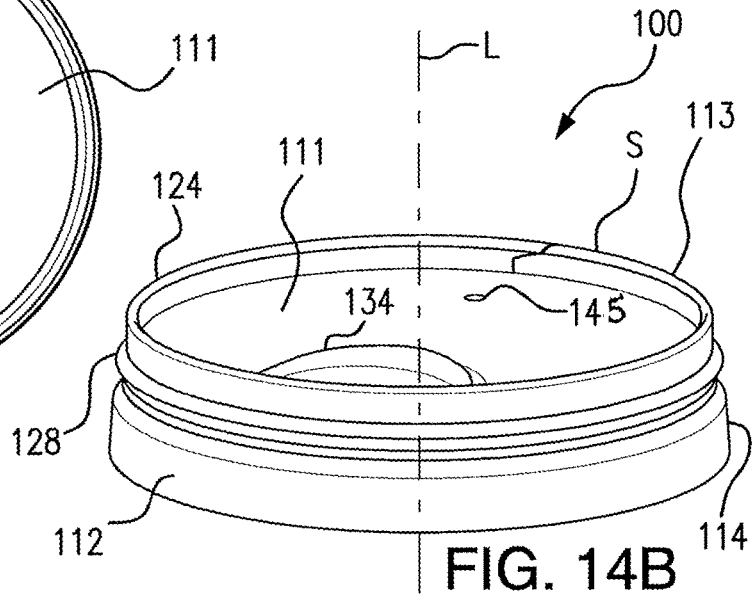
FIG. 14B is a perspective view.
Figure 14C:
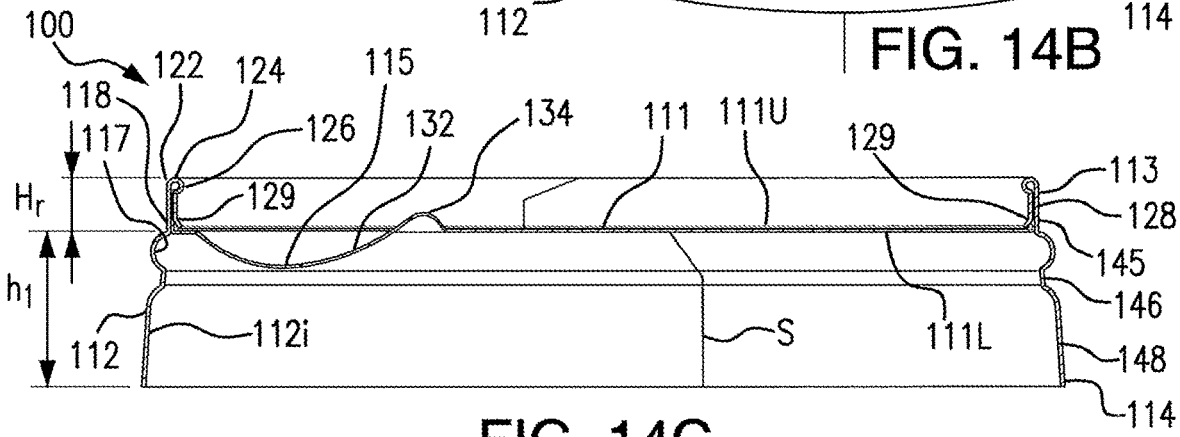
FIG. 14C is a cross sectional view showing the sealing channel 117 and the joint section 118 between the top wall 111 and the side wall 112 of the lid.

As shown in FIG. 14C, the top wall 111 of the lid 100 is connected to the side wall 112 proximate the first end 113. Top wall 111 includes an opening 115 formed therein which will allow a user access to the contents of the container without having to remove lid 100. Those skilled in art will recognize that an "opening" can include a hole provided in the lid during the manufacturing process or an area of material, such as a region surrounded by a perforation line, which is adapted to be removed by the user of the lid.

As best viewed in FIG. 14C, lid 100 further includes a sealing channel 117 formed in the side wall 112 between the first end 113 and the second end 114. In the embodiment of the present disclosure shown in this figure, the sealing channel 117 projects radially outward from the longitudinal axis L.

The side wall 112 of the lid includes a substantially vertical seam "S" that extends between the first end 113 and the second end 114 of the side wall 112. The seam S is compressed to reduce its step height. As shown in FIG. 14B, it is preferable to have the opening 115 positioned opposite of the seam S, so as to decrease the potential for leakage along the seam line when a user is drinking from the container, for example.

The side wall 112 of lid 100 includes an inner surface 112*i* which has a polymer coating. The top wall 111 includes a lower surface 111L and an upper surface 111U which each include a polymer coating. The upper surface 111U of the top wall 111 is connected to the inner surface 112*i* of the side wall 112 by a polymer-to-polymer bond and the lower surface 111L of the top wall 111 is connected to the inner surface 112*i* of the side wall 112 by a polymer-to-polymer bond. Those skilled in the art will readily appreciate that other methods of joining the top wall to the bottom wall, including methods that use an adhesive rather than a polymer-to-polymer bond can be used in the present lid construction. Moreover, the outer surface of the side wall may also include a polymer coating to facilitate a polymer-to-polymer bond along the seam "S".

Lid 100 includes a joint section 118 defined by where the first end 113 of the side wall 112 is connected to the top wall 111. The joint section 118 includes a top end 122 that forms a lid rim 124 and the lid rim 124 includes a substantially rounded section or in-curled section 126. The substantially rounded section 126 of the lid rim 124 is oriented toward the longitudinal axis L and provides a surface with more pleasing mouth-feel for the user. The opening 115 is formed in the lid 100 below the rim 124. As shown in FIG. 14A, a second opening 144 is provided in the top wall 111 of the lid 100 for venting.

The joint section 118 further includes a middle section 128 below the top end 122. The rim 124 has a width associated therewith and the middle section 128 has a width associated therewith. As shown in the figure, the width of the rim 124 is greater than the width of the middle section 128.

As shown in FIG. 14C, the joint section 118 of lid 100 includes a bottom end 129 below the middle section 128. The bottom end 129 flares toward the longitudinal axis L and facilitates creating the joint between the top wall 111 and the side wall 112.

Moreover, the top wall 111 includes a debossed section 132 and the opening 115 is located within the debossed section 132. The top wall 111 further includes an embossed section 134 located adjacent to and around the periphery of the debossed section 132. The combination of these two features creates and area with liquid can collect and return to the container through opening 115.

As shown in FIG. 14C, the outwardly projecting sealing channel 117 has an upper portion associated therewith, and the top wall 111 is connected to the side wall 112 adjacent to the upper portion of the outwardly projecting sealing channel 117.

Figure 15A:
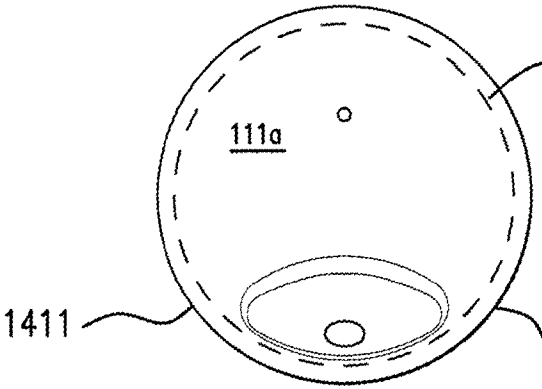
FIGS. 15A and 15B illustrate the blanks used to form the container lid illustrated in FIGS. 14A-14D.
Figure 15B:
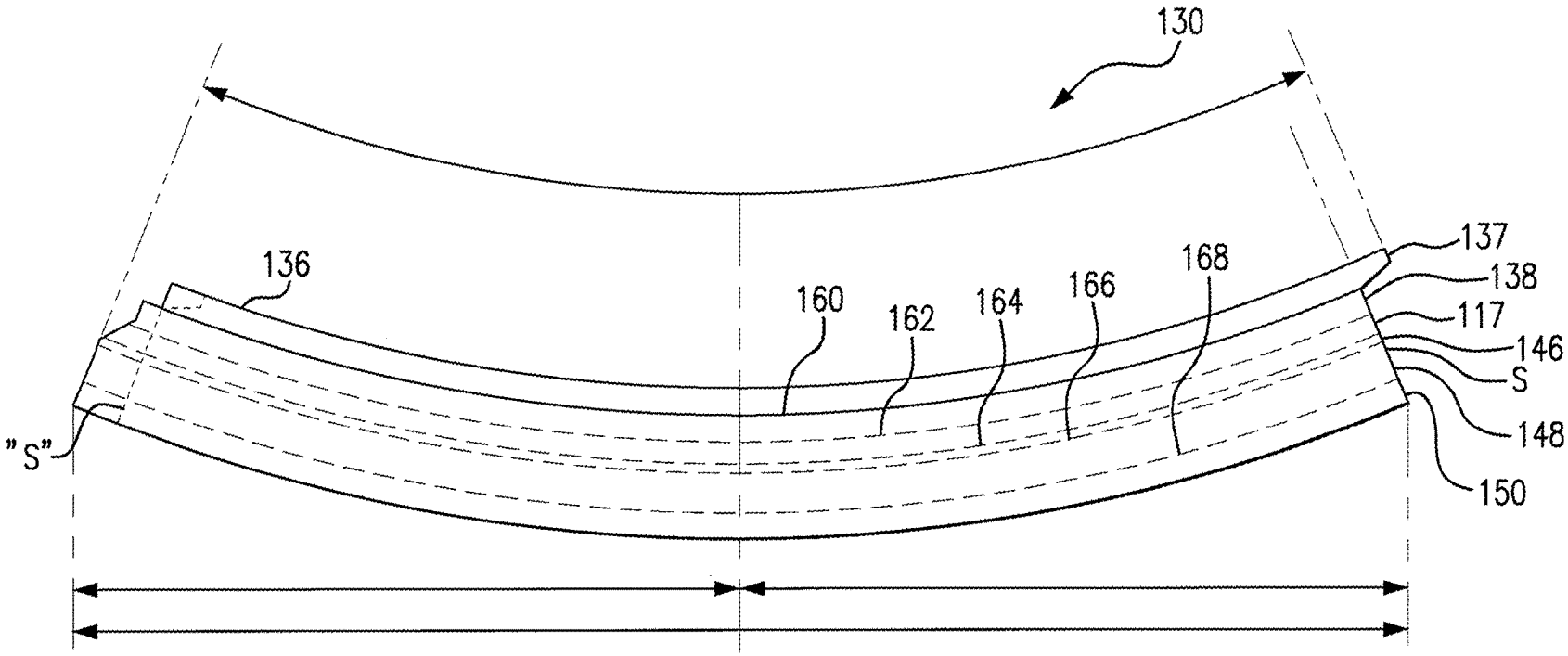

Referring now to the blank 130 shown in FIG. 15B. Blank 130 includes a flap section 137 separated from a flange section 138 by fold line 160. When the lid is assembled, flap section 137 is folded over the flange section 138 to create the lid rim 124. Below the flange section 138 is a section of material that is bound between dashed lines 162 and 164. This section of material is to create the sealing channel 117. Between dashed lines 164 and 166 is a section of material which is used to create a first flared section 146 (see FIG. 14B) in the side wall 111. A second flared section 148 is created in the sidewall between dashed lines 166 and 168 and the material located below dashed line 168 may be trimmed off.

As shown in FIG. 15A, blank 140 includes a line 142 which represents the line on which the upwardly projection peripheral flange 145 is formed in the top wall 111 either by folding or pressing. During the assembly process for certain embodiment of the present invention, peripheral flange 145 is sandwiched between the flange section 137 and the flap section 138 of the side wall 112.

Figure 14D:
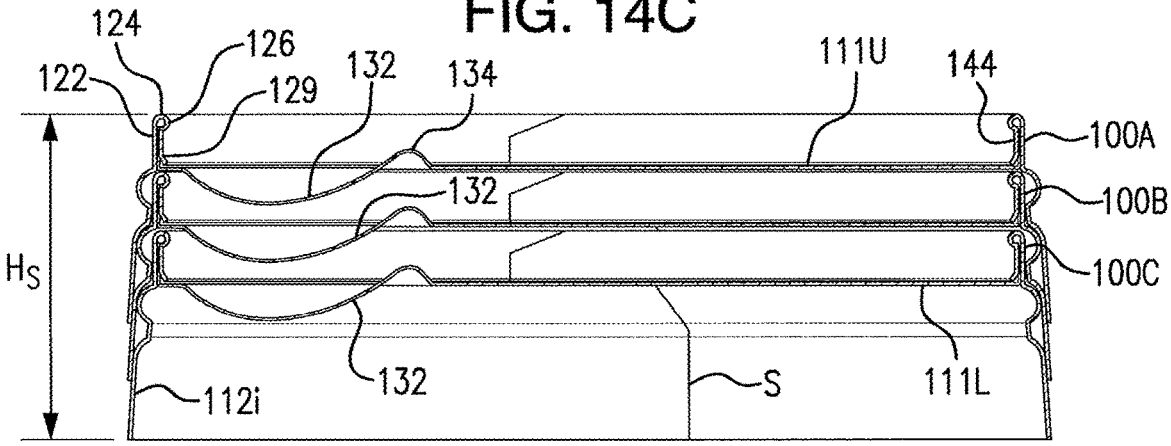
FIG. 14D is a cross sectional view showing a stack of three lids.

Referring to FIG. 14D which illustrates three lids 100A, 100B and 100C in a stacked arrangement. By flaring outwardly the second end 114 of the side wall 112, the stack height of the lids can be reduced. The outward slope may also help with putting the lid on a cup. As described with respect to FIG. 1D, the height Hs of the stack may be determined in large part by the rim height Hr. The rim height Hr and skirt height h1 may be chosen according to manufacturing preference.

As described with respect to FIG. 2B, the diameter Di of the inside of the flare should be greater than the diameter Do of the outside of the sealing channel 117, so that the flare and the sealing channel are not in contact with each other. This may reduce friction or sticking between the lids. Friction or sticking is inconvenient to the user, and may result in a variable stacking height for the lids. With reduced friction between lids, the stack height Hs can be more consistent (at approximately Hr times the number of lids in the stack). The sealing channel 117 may be located just below the top wall as shown in FIG. 14C, or it may be located further downward from the top wall.

The containers suitable for use in the present disclosure may include paper-based materials, plastics, composite materials, or combinations thereof. Various paper-based substrates may be used for the containers. Examples of such materials include, but are not limited to, paperboard, corrugated board, cardboard, and combinations thereof.

It is believed that the present disclosure includes many other embodiments that may not be herein described in detail, but would nonetheless be appreciated by those skilled in the art from the disclosures made. Accordingly, this disclosure should not be read as being limited only to the foregoing examples or only to the designated embodiments.

What is claimed is:

1. A paperboard lid, comprising:

a paperboard top wall transverse to a longitudinal axis, comprising:
- a cover comprising a debossed section;
- an opening located within the debossed section;
- an embossed section located around the periphery of the debossed section and adjacent to the debossed section; and
- a vertical wall extending upward from the cover;
- a cross-section of the embossed section and the debossed section each being continuously curved and the embossed section and the debossed section define a continuously curved surface; and
- a cross-sectional area of the continuously curved surface of the embossed section and the debossed section merge in a smooth and continuous manner; and a paperboard sidewall circumferentially extending about the longitudinal axis, comprising:
- a first end;
- a second end;
- a sealing channel between the first end and the second end, the sealing channel comprising an arcuate recess configured to closely receive a rim of a container; and
- a joint section, comprising a portion of the sidewall between the sealing channel and the first end folded over the vertical wall of the top wall.

2. The paperboard lid of claim 1, wherein the sealing channel is immediately adjacent the cover.

3. The paperboard lid of claim 2, wherein the sealing channel projects radially outward.

4. The paperboard lid of claim 1, further comprising a flared skirt between the sealing channel and the second end.

5. The paperboard lid of claim 1, wherein the joint section includes a top end forming a lid rim having a substantially rounded section.

6. The paperboard lid of claim 5, wherein the substantially rounded section is oriented toward the longitudinal axis.

* * * * *